US010240805B2

(12) United States Patent
Nouchi et al.

(10) Patent No.: US 10,240,805 B2
(45) Date of Patent: Mar. 26, 2019

(54) INDOOR UNIT FOR AIR CONDITIONER

(71) Applicant: DAIKIN INDUSTRIES, LTD., Osaka-shi, Osaka (JP)

(72) Inventors: Yoshiteru Nouchi, Osaka (JP); Nobuyuki Kojima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 100 days.

(21) Appl. No.: 15/515,947

(22) PCT Filed: Sep. 7, 2015

(86) PCT No.: PCT/JP2015/004537
§ 371 (c)(1),
(2) Date: Mar. 30, 2017

(87) PCT Pub. No.: WO2016/051676
PCT Pub. Date: Apr. 7, 2016

(65) Prior Publication Data

US 2017/0307232 A1 Oct. 26, 2017

(30) Foreign Application Priority Data

Sep. 30, 2014 (JP) ..... 2014-200363

(51) Int. Cl.
*F24F 1/0014* (2019.01)
*F24F 13/20* (2006.01)
(Continued)

(52) U.S. Cl.
CPC ..... *F24F 1/0014* (2013.01); *F24F 13/20* (2013.01); *F24F 13/32* (2013.01); *F24F 2001/0037* (2013.01); *F24F 2221/26* (2013.01)

(58) Field of Classification Search
CPC ..... F24F 2001/0037; F24F 2221/26
(Continued)

(56) References Cited

U.S. PATENT DOCUMENTS 5,620,370 A * 4/1997 Umai ..... F04D 29/4213 181/225
6,460,365 B2 * 10/2002 Kim ..... F24F 1/0007 165/54
(Continued)

FOREIGN PATENT DOCUMENTS

EP 1139034 A1 10/2001
EP 2626646 A1 8/2013
(Continued)

OTHER PUBLICATIONS

International Search Report for PCT/JP2015/004537 (PCT/ISA/210) dated Dec. 22, 2015.

*Primary Examiner* — Gregory L Huson
*Assistant Examiner* — Frances F. Hamilton
(74) *Attorney, Agent, or Firm* — Birch, Stewart, Kolasch & Birch, LLP

(57) ABSTRACT

A grille is provided at a lower end portion of an air inlet, and covers a central portion of the air inlet to form an inlet opening between an outer peripheral edge of the grille and an opening edge of the air inlet in plan view. A plate member extends along an inner surface of the air inlet, and provided inside the air inlet such that an upper edge of the plate member is located more inward than a lower edge of the plate member. The upper edge of the plate member is located above the lower end of the air inlet. The lower edge of the plate member surrounds an outer periphery of the grille in plan view.

16 Claims, 15 Drawing Sheets

(51) Int. Cl.
*F24F 13/32* (2006.01)
*F24F 1/00* (2019.01)

(58) Field of Classification Search
USPC ..... 454/233
See application file for complete search history.

(56) References Cited

U.S. PATENT DOCUMENTS

| | | | | |
|---|---|---|---|---|
| 7,530,189 | B2 * | 5/2009 | Kim | F24F 1/0007 40/725 |
| 8,230,693 | B2 * | 7/2012 | Tsuji | F24F 1/0007 454/322 |
| 8,387,404 | B2 * | 3/2013 | Choi | F24F 1/0007 62/132 |
| 8,715,047 | B2 * | 5/2014 | Kim | F24F 1/0007 454/254 |
| 9,255,717 | B2 * | 2/2016 | Nam | F24F 1/0007 |
| 2017/0343235 | A1 * | 11/2017 | Nakai | F24F 13/20 |

FOREIGN PATENT DOCUMENTS

| | | | | | |
|---|---|---|---|---|---|
| JP | 4-64041 | U | | 6/1992 | |
| JP | 06082074 | A | * | 3/1994 | |
| JP | 7-158923 | A | | 6/1995 | |
| JP | 07158923 | A | * | 6/1995 | F04D 29/4213 |
| JP | 2856210 | B1 | * | 2/1999 | |
| JP | 11-281084 | A | | 10/1999 | |
| JP | 11281084 | A | * | 10/1999 | |
| JP | 2000-46366 | A | | 2/2000 | |
| JP | 2006-329518 | A | | 12/2006 | |
| JP | 2011231975 | A | * | 11/2011 | |

* cited by examiner

INDOOR UNIT FOR AIR CONDITIONER

TECHNICAL FIELD

The present disclosure relates to an indoor unit for an air conditioner, and more particularly, an indoor unit for an air conditioner provided in a ceiling.

BACKGROUND ART

A typically known indoor unit for an air conditioner is provided in a ceiling. For example, Patent Document 1 shows a ceiling air conditioner (i.e., an indoor unit) including a casing, a decorative panel, and an inlet grille. The casing includes an indoor fan and an indoor heat exchanger inside, and is mounted in the ceiling. The decorative panel is attached to the lower end of the casing. The inlet grille is attached to an air inlet formed at a central portion of the decorative panel. This inlet grille includes a grille frame and a rectangular closed surface. The grille frame constitutes the outer edge of the grille. The closed surface constitutes the central portion of the grille. The closed surface projects beyond the grille frame to the inside of a room (i.e., downward). An inlet opening is formed between the grille frame and the closed surface.

CITATION LIST

Patent Document

[PATENT DOCUMENT 1] Japanese Unexamined Patent Publication No. 2000-46366

SUMMARY OF THE INVENTION

Technical Problem

However, in the air conditioner of Patent Document 1, inner parts of the indoor unit might be visible through the inlet opening formed between the grille frame and the closed surface. It is thus difficult to improve the design of the decorative panel.

In the air conditioner of Patent Document 1, reducing the opening area of the inlet opening is considered to improve the design of the decorative panel. For example, the distance between bars may be reduced by increasing the widths of the bars provided for the inlet opening. However, with a decrease in the opening area of the inlet opening, the ventilation resistance increases at the inlet opening. This might increase workload (specifically, the number of rotation of the fan) for sucking air in the indoor unit, thereby increasing noise in the indoor unit.

It is an object of the present disclosure to provide an indoor unit for an air conditioner including a decorative panel with an improved design, while reducing an increase in the ventilation resistance at an inlet opening.

Solution to the Problem

A first aspect of the present disclosure provides an indoor unit for an air conditioner provided in a ceiling (CE). The indoor unit includes an indoor unit body (20) including an indoor fan (31) and an indoor heat exchanger (32) inside, mounted in the ceiling (CE), controlling a temperature of air sucked from below, and blowing out the air; and a decorative panel (50) provided under the indoor unit body (20). The decorative panel (50) includes a panel body (51) vertically penetrated by an air inlet (51*a*) at its central portion, and by air outlets (51*b*) around the air inlet (51*a*), a grille (52) being a plate provided at a lower end portion of the air inlet (51*a*), and covering a central portion of the air inlet (51*a*) to form an inlet opening (60) between an outer peripheral edge of the grille (52) and an opening edge of the air inlet (51*a*) in plan view, and a plate member (53) extending along an inner surface of the air inlet (51*a*), and provided inside the air inlet (51*a*) such that an upper edge of the plate member (53) is located more inward than a lower edge of the plate member (53). The upper edge of the plate member (53) is located above the lower end of the air inlet (51*a*). The lower edge of the plate member (53) surrounds an outer periphery of the grille (52) in plan view.

In the first aspect, the plate member (53) is provided to secure the opening area of the inlet opening (60) and make the inner parts of the indoor unit (10) less visible through the inlet opening (60).

According to a second aspect of the present disclosure, in the first aspect, the plate member (53) curves to be recessed from the outer peripheral edge of the grille (52).

The second aspect provides a relatively long distance between the plate member (53) and the grille (52). This reduces ventilation resistance on an inner side of the plate member (53), and smoothens the air flowing through the inner side of the plate member (53).

According to a third aspect of the present disclosure, in the first or second aspect, the lower edge of the plate member (53) is located between inner and outer peripheral edges of the inlet opening (60) in plan view, and divides the inlet opening (60) into a first inlet opening (61) and a second inlet opening (62) in plan view. The first inlet opening (61) is located more inward than the lower edge of the plate member (53). The second inlet opening (62) is located more outward than the lower edge of the plate member (53).

In the third aspect, a second ventilation path (R2) is formed inside the air inlet (51*a*) in addition to a first ventilation path (R1). The first ventilation path (R1) passes through the inner side of the plate member (53). The second ventilation path (R2) passes through an outer side of the plate member (53).

According to a fourth aspect of the present disclosure, in the third aspect, the first inlet opening (61) has a larger opening area than the second inlet opening (62).

In the fourth aspect, the ventilation resistance at the entrance of the first ventilation path (R1) is lower than that at the entrance of the second ventilation path (R2). This accelerates the air flowing into the first ventilation path (R1).

According to a fifth aspect of the present disclosure, in the third or fourth aspect, a first opening (63) surrounded by the upper edge of the plate member (53) has a larger opening area than a second opening (64) interposed between the upper edge of the plate member (53) and an inner peripheral surface of the air inlet (51*a*) in plan view.

In the fifth aspect, the ventilation resistance at the exit of the first ventilation path (R1) is lower than that at the exit of the second ventilation path (R2). This accelerates the air flowing out of the first ventilation path (R1).

According to a sixth aspect of the present disclosure, in the fifth aspect, a ratio of the opening area of the first inlet opening (61) to the second inlet opening (62) is higher than or equal to a ratio of the opening area of the first opening (63) to the second opening (64).

The sixth aspect smoothens the air flowing through the first ventilation path (R1) as compared to the case where the ratio of the opening area of the first inlet opening (61) to the second inlet opening (62) is lower than the ratio of the opening area of the first opening (63) to the second opening (64).

According to a seventh aspect of the present disclosure, in any one of the second to sixth aspects, a curvature radius (CR) of the plate member (53) having a curvature center at the outer peripheral edge of the grille (52) gradually increases from the lower edge toward the upper edge of the plate member (53).

In the seventh aspect, the distance between the plate member (53) and the grille (52) gradually increases from the lower edge toward the upper edge of the plate member (53). This gradually reduces the ventilation resistance on the inner side of the plate member (53) from the lower edge toward the upper edge of the plate member (53), and thus smoothens the air flowing through the inner side of the plate member (53).

According to an eighth aspect of the present disclosure, in any one of the first to seventh aspects, the lower edge of the plate member (53) is at a same height as or higher than the lower end of the air inlet (51*a*).

In the eighth aspect, the plate member (53) is less conspicuous than in the case where the lower edge of the plate member (53) projects downward beyond the air inlet (51*a*).

According to a ninth aspect of the present disclosure, in any one of the first to eighth aspects, the lower edge of the plate member (53) is located more outward than a centerline (CL) between inner and outer peripheral edges of the inlet opening (60) in plan view.

In the ninth aspect, the gap between the outer peripheral edge of the inlet opening (60) and the lower edge of the plate member (53) is smaller than in the case where the lower edge of the plate member (53) is more inward than the center line (CL) in plan view. This makes the inner parts of the indoor unit (10) less visible through the inlet opening (60).

According to a tenth aspect of the present disclosure, in any one of the first to ninth aspects, the upper edge of the plate member (53) overlaps the outer peripheral edge of the grille (52) or is more inward than the outer peripheral edge of the grille (52) in plan view.

The tenth aspect makes the inner parts of the indoor unit (10) invisible in the region of the inlet opening (60) more inward than the lower edge of the plate member (53) is.

According to an eleventh aspect of the present disclosure, in any one of the first to tenth aspects, a lower surface of the grille (52) is at a same height as or higher than the lower end of the air inlet (51*a*).

The eleventh aspect provides improved integration between the panel body (51) and the grille (52) as compared to the case where the grille (52) projects below the panel body (51).

A twelfth aspect of the present disclosure, in any of the first to eleventh aspects, the plate member (53) includes a first connecting portion (53*a*) extending to an inside of the air inlet (51*a*) to be connected to an inner peripheral portion of the air inlet (51*a*), and a second connecting portion (53*b*) extending to the grille (52) to be connected to the grille (52).

In the twelfth aspect, the first and second connecting portions (53*a*) and (53*b*) are provided for the plate member (53). The first connecting portion (53*a*) connects the plate member (53) to the inner peripheral portion of the air inlet (51*a*). The second connecting portion (53*b*) connects the plate member (53) to the grille (52).

Advantages of the Invention

The first aspect of the present disclosure secures the opening area of the inlet opening (60), and makes the inner parts of the indoor unit (10) less visible through the inlet opening (60). This reduces an increase in the ventilation resistance at the inlet opening (60), and improves the design of the decorative panel (50).

The second aspect of the present disclosure reduces the ventilation resistance on the inner side of the plate member (53), and thus accelerates the air flowing through the central portion of the air inlet (51*a*).

The third aspect of the present disclosure provides inside the air inlet (51*a*), the second ventilation path (R2) in addition to the first ventilation path (R1). This configuration reduces the ventilation resistance at the air inlet (51*a*), and smoothens the air flowing through the air inlet (51*a*).

The fourth aspect of the present disclosure accelerates the air flowing into the first ventilation path (R1), and thus accelerates the air flowing through the central portion of the air inlet (51*a*).

The fifth aspect of the present disclosure accelerates the air flowing out of the first ventilation path (R1), and thus accelerates the air flowing through the central portion of the air inlet (51*a*).

The sixth aspect of the present disclosure smoothens the air flowing through the first ventilation path (R1), and thus accelerates the air flowing through the central portion of the air inlet (51*a*).

The seventh aspect of the present disclosure gradually reduces the ventilation resistance on the inner side of the plate member (53) from the lower edge toward the upper edge of the plate member (53), and thus accelerates the air flowing through the central portion of the air inlet (51*a*).

The eighth aspect of the present disclosure makes the plate member (53) less conspicuous, and thus improves the design of the decorative panel (50).

The ninth aspect of the present disclosure makes the inner parts of the indoor unit (10) less visible through the inlet opening (60), and thus improves the design of the decorative panel (50).

The tenth aspect of the present disclosure makes the inner parts of the indoor unit (10) invisible in the region of the inlet opening (60) more inward than the lower edge of the plate member (53), and thus improves the design of the decorative panel (50).

The eleventh aspect of the present disclosure improves the integration between the panel body (51) and the grille (52), and thus improves the design of the decorative panel (50).

In the twelfth aspect of the present disclosure, the first connecting portion (53*a*) connects the plate member (53) to the inner peripheral portion of the air inlet (51*a*), and the second connecting portion (53*b*) connects the plate member (53) to the grille (52). This configuration supports the plate member (53) and the grille (52).

DESCRIPTION OF EMBODIMENTS

Figure 1:
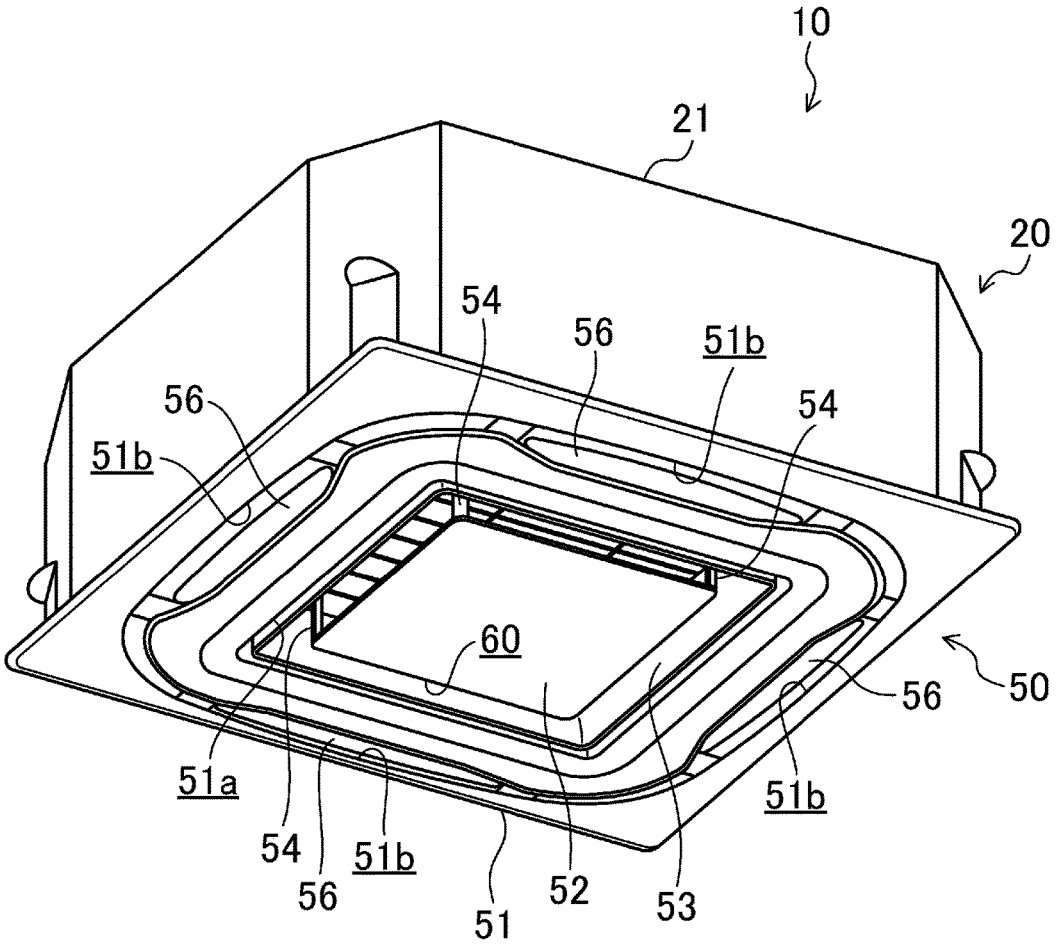
FIG. 1 is a perspective view illustrating an appearance of an indoor unit for an air conditioner according to an embodiment 1.

Embodiments will now be described in detail with reference to the drawings. The same reference characters are used to represent identical or equivalent elements, and the explanation thereof will be omitted.

Embodiment 1

FIG. 1 illustrates an exemplary configuration of an indoor unit (10) of an air conditioner according to an embodiment 1. The indoor unit (10) is provided in a ceiling (CE) inside a room whose air is to be conditioned. The indoor unit (10) is connected to an outdoor unit (not shown) by pipes to form an air conditioner. This air conditioner performs air conditioning such as cooling or heating.

Figure 2:
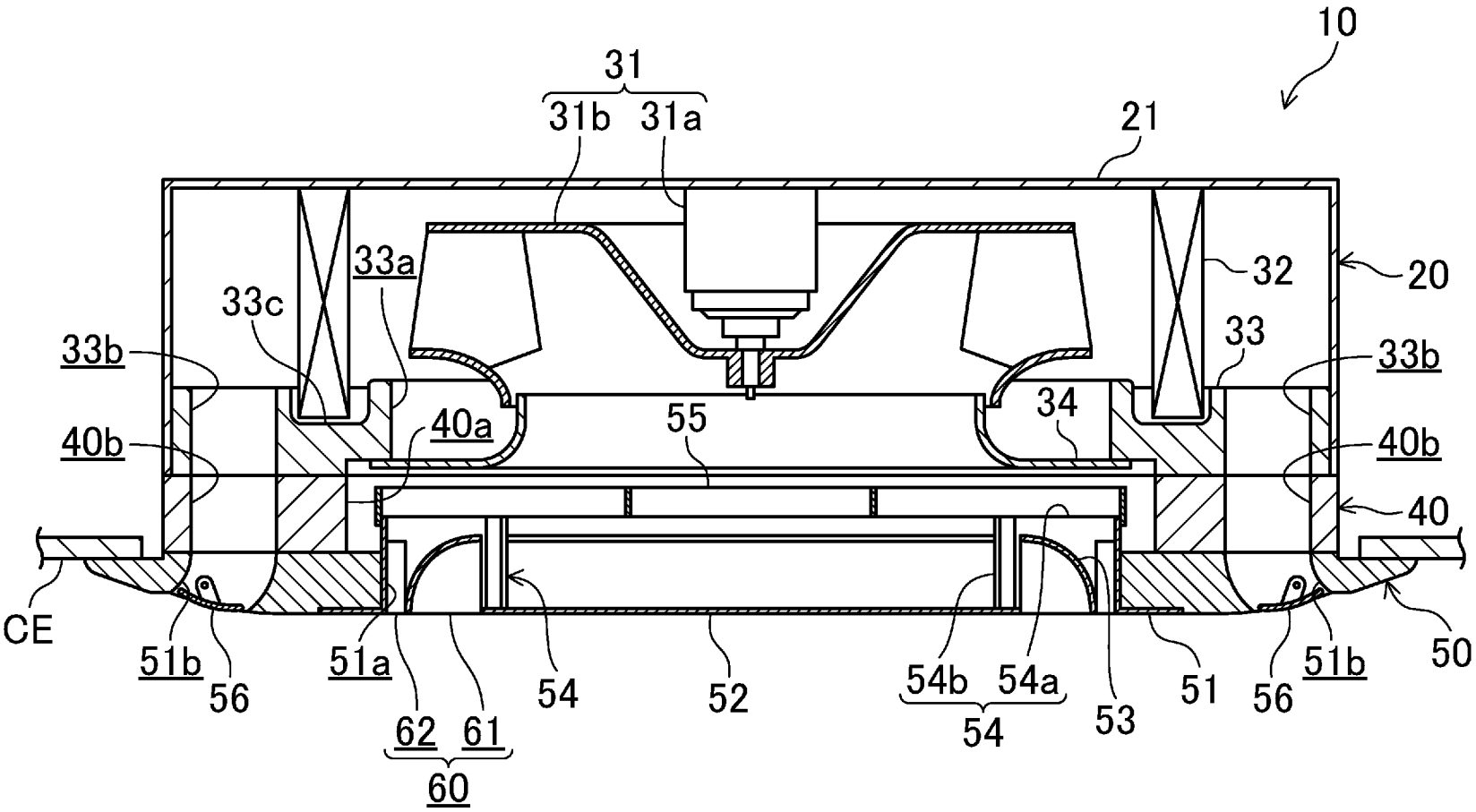
FIG. 2 is a longitudinal sectional view illustrating an exemplary configuration of the indoor unit according to the embodiment 1.
Figure 3:
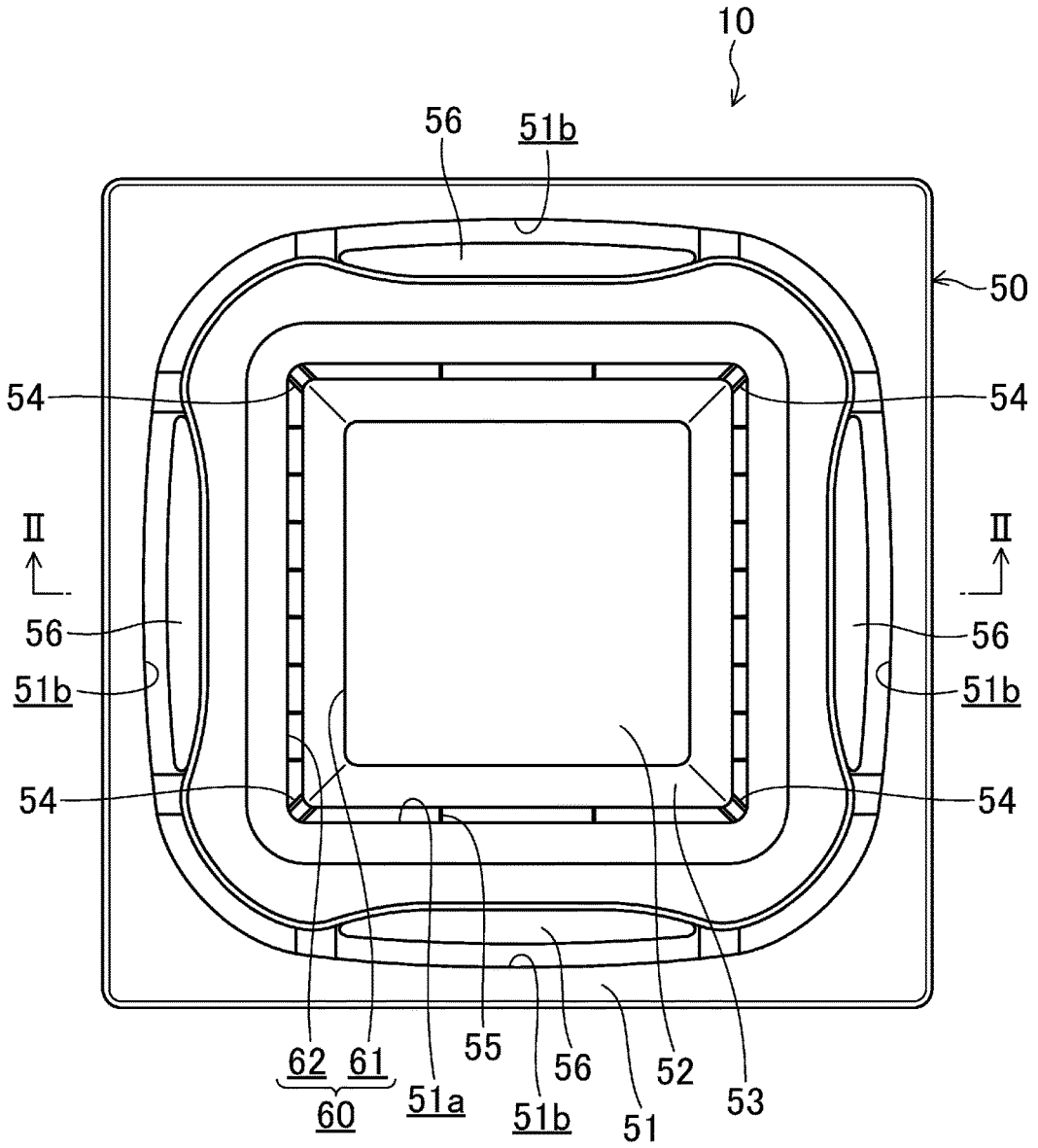
FIG. 3 is a bottom view illustrating the exemplary configuration of a decorative panel according to the embodiment 1.
Figure 4:
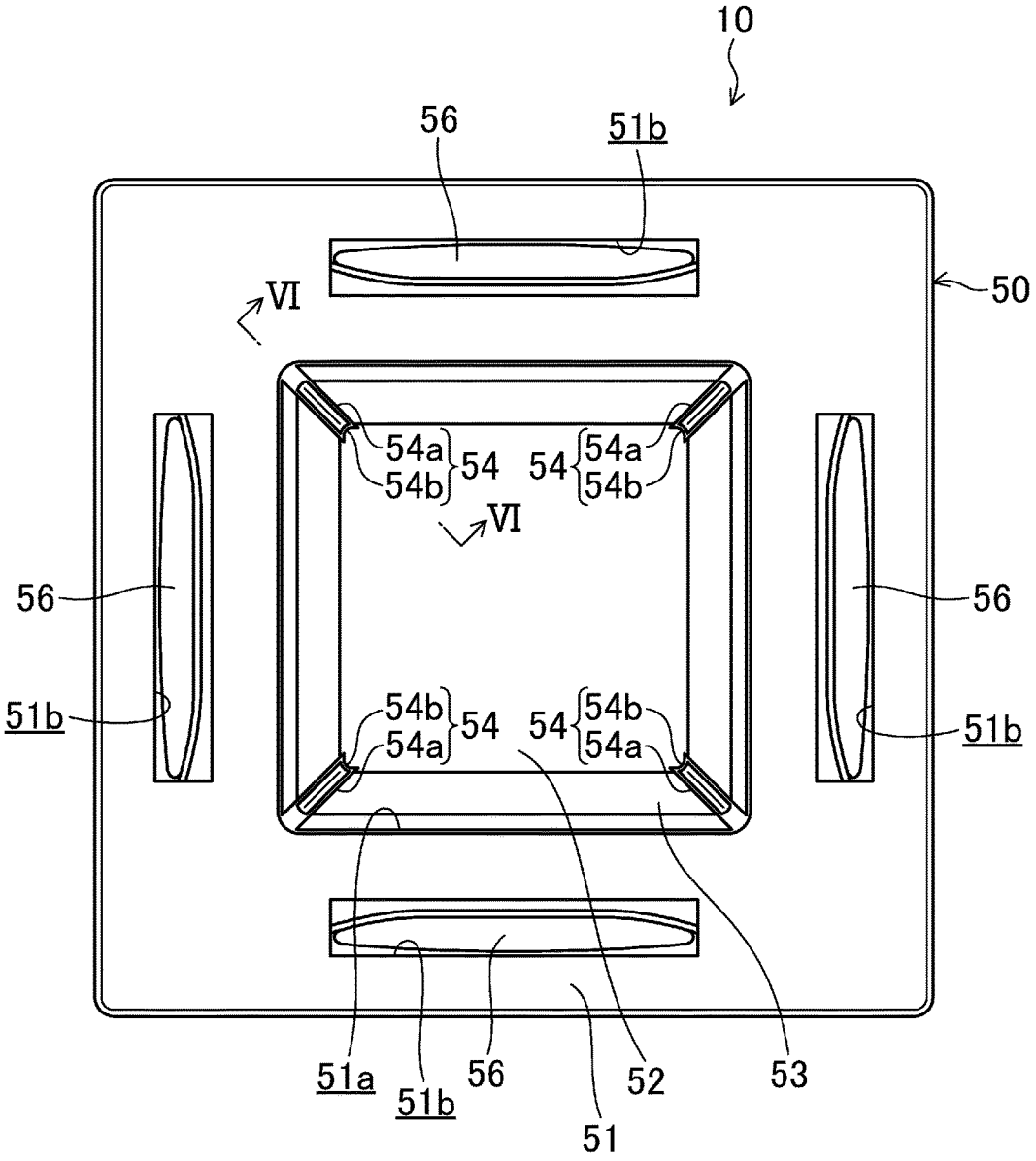
FIG. 4 is a top view illustrating the exemplary configuration of the decorative panel according to the embodiment 1.

As shown in FIGS. 1 to 4, the indoor unit (10) includes an indoor unit body (20), a chamber (40), and a decorative panel (50). In this example, the indoor unit (10) is suspended by a suspender mechanism (not shown) located in a space above a ceiling (CE) (i.e., in a ceiling plenum). FIG. 1 is a perspective view of the indoor unit (10) as seen obliquely from below. FIG. 2 is a longitudinal sectional view of the indoor unit (10) taken along the line II-II of FIG. 3. FIG. 3 is a bottom view of the decorative panel (50) as seen from below. FIG. 4 is a top view of the decorative panel (50) as seen from above.

Indoor Unit Body

The indoor unit body (20) includes an indoor fan (31) and an indoor heat exchanger (32) inside and is provided in the ceiling (CE). The indoor unit body (20) controls a temperature of air sucked from below, and blows out the air. In this example, the indoor unit body (20) includes a casing (21), a drain pan (33), and a bell mouth (34) in addition to the indoor fan (31) and the indoor heat exchanger (32).

Casing

The casing (21) is like a rectangular parallelepiped box with an openable lower surface. A heat insulating material (not shown) is provided on the inner surface of the casing (21). The casing (21) houses the indoor fan (31), the indoor heat exchanger (32), the drain pan (33), and the bell mouth (34).

Indoor Fan

The indoor fan (31) is disposed at the center in the casing (21). In this example, the indoor fan (31) blows air, which has been sucked from below, radially outward from sides. Specifically, the indoor fan (31) includes a fan motor (31*a*) and a vaned wheel (31*b*). The fan motor (31*a*) is fixed to the top plate of the casing (21). The vaned wheel (31*b*) is connected to the rotation shaft of the fan motor (31*a*).

Indoor Heat Exchanger

The indoor heat exchanger (32) surrounds the indoor fan (31), and performs heat exchange between refrigerant and air transported by the indoor fan (31). For example, the indoor heat exchanger (32) is a fin and tube heat exchanger of a cross-fin type. The indoor heat exchanger (32) is connected to a compressor, an outdoor heat exchanger, and an expansion valve by pipes to form a refrigerant circuit. The indoor heat exchanger (32) is provided in the indoor unit (10). The compressor, the outdoor heat exchanger, and the expansion valve are provided in an outdoor unit (not shown). The refrigerant circulates in forward and reverse directions to allow this refrigerant circuit to perform vapor compression refrigeration cycles. The indoor heat exchanger (32) functions as an evaporator in cooling operations to cool air, and functions as a radiator (condenser) in heating operations to heat air.

Drain Pan

The drain pan (33) has a rectangular parallelepiped shape with a low height, and is disposed under the indoor heat exchanger (32). A single air inlet (33*a*), a plurality of (four in this example) air outlets (33*b*), and a drain groove (33*c*) are formed in the drain pan (33). The air inlet (33*a*) is formed at the central portion of the drain pan (33), and vertically penetrates the drain pan (33). The four air outlets (33*b*) surround the air inlet (33*a*) and vertically penetrate the drain pan (33). The drain groove (33*c*) has a ring shape extending along the lower end of the indoor heat exchanger (32), and receives water condensed in the indoor heat exchanger (32). In this example, each of the four air outlets (33*b*) extends along one of four sides of the drain pan (33) in plan view. The drain groove (33*c*) extends in a ring shape between the air inlet (33*a*) and the four air outlets (33*b*) in plan view.

Bell Mouth

The bell mouth (34) has a cylindrical shape with an opening area increasing from its upper edge to its lower edge. With the upper edge of the bell mouth (34) inserted into the lower open end (i.e., the inlet) of the indoor fan (31), the bell mouth (34) is contained in the air inlet (33*a*) of the drain pan (33).

Chamber

The chamber (40) has a rectangular parallelepiped shape with a low height, and is disposed under the indoor unit body (20). A single inlet opening (40*a*) for communication, and a plurality of (four in this example) outlet openings (40*b*) for communication are formed in the chamber (40). The inlet opening (40*a*) is formed at the central portion of the chamber (40), and vertically penetrates the chamber (40) to communicate with the air inlet (33*a*) of the drain pan (33). The four outlet openings (40*b*) surround the inlet opening (40*a*). Each of the four outlet openings (40*b*) vertically penetrates the chamber (40) to communicate with one of the four air outlets (33*b*) of the drain pan (33). In this example, each of the four outlet openings (40*b*) extends along one of four sides of the chamber (40) in plan view.

Decorative Panel

The decorative panel (50) is provided below the indoor unit body (20) with the chamber (40) interposed therebetween. The decorative panel (50) includes a panel body (51), a grille (52), a plate member (53), a plurality of (four in this example) suspending supports (54), a filter (55), and a plurality of (four in this example) air flow direction control vanes (56).

Panel Body

The panel body (51) has a rectangular parallelepiped shape with a low height. A single air inlet (51*a*) and a plurality of (four in this example) air outlets (51*b*) are formed in the panel body (51). In this example, the panel body (51) has a square shape in plan view. The central portion (specifically, the portion more inward than the four air outlets (51*b*)) of the lower surface of the panel body (51) is flat, and an outer peripheral edge portion of the lower surface is inclined gently upward toward the outer periphery.

The air inlet (51*a*) is formed at the central portion of the panel body (51), and vertically penetrates the panel body (51) to communicate with the inlet opening (40*a*) of the chamber (40). Specifically, the air inlet (51*a*) communicates with the air inlet (33*a*) of the drain pan (33) via the inlet opening (40*a*) of the chamber (40). In this example, the air inlet (51*a*) has a square shape in plan view. The opening area of the air inlet (51*a*) is uniform from its upper end to its lower end.

The four air outlets (51*b*) surround the air inlet (51*a*). Each air outlet (51*b*) vertically penetrates the panel body (51) to communicate with one of the four outlet openings (40*b*) of the chamber (40). Specifically, the four air outlets (51*b*) communicate with the four air outlets (33*b*) of the drain pan (33) via the four outlet openings (40*b*) of the chamber (40). In this example, each of the four air outlets (51*b*) extends along one of four sides of the panel body (51).

In the following description, the words "inward" and "inner side" are used to represent the side closer to the center of the air inlet (51*a*) in plan view, and the words "outward" and "outer side" are used to represent the side farther from the center of the air inlet (51*a*) in plan view.

Grille

The grille (52) is a plate (specifically, a non-porous plate) blocking air flow, and provided at the lower end portion of the air inlet (51*a*). The grille (52) covers the central portion of the air inlet (51*a*) to form an inlet opening (60) between the outer peripheral edge of the grille (52) and the opening edge of the air inlet (51*a*) in plan view.

In this example, the grille (52) is a square plate smaller than the air inlet (51*a*), which has a square shape in plan view. The grille (52) is provided at the lower end portion of the air inlet (51*a*) such that the lower surface of the grille (52) is at the same height as the lower end of the air inlet (51*a*). The lower surface of the grille (52) is flat, and is flush with the central portion of the lower surface of the panel body (51) with the inlet opening (60) interposed therebetween.

The state that "the lower surface of the grille (52) is at the same height as the lower end of the air inlet (51*a*)" includes not only the state that the lower surface of the grille (52) is at exactly the same height as the lower end of the air inlet (51*a*) (e.g., there is no difference in height between the lower surface of the grille (52) and the lower end of the air inlet (51*a*)) but also the state that the lower surface of the grille (52) is at substantially the same height as the lower end of the air inlet (51*a*) (e.g., there is a difference in height within about 5 mm between the lower surface of the grille (52) and the lower end of the air inlet (51*a*)).

Plate Member

The plate member (53) extends along the inner surface of the air inlet (51*a*). The plate member (53) is provided inside the air inlet (51*a*) such that the upper edge of the plate member (53) is located more inward than the upper edge of the plate member (53). The upper edge of the plate member (53) is located above the lower end of the air inlet (51*a*). The lower edge of the plate member (53) surrounds the outer periphery of the grille (52) in plan view.

In this example, the plate member (53) extends continuously along the entire inner surface of the air inlet (51*a*). The plate member (53) curves to be recessed from the outer peripheral edge of the grille (52). Specifically, the plate member (53) has a frame shape with a square transverse section. The plate member (53) curves like an arc to be recessed from the outer peripheral edge of the grille (52) such that the upper edge of the plate member (53) is more inward than the lower edge of the plate member (53).

In this example, the lower edge of the plate member (53) is located between the inner and outer peripheral edges of the inlet opening (60) in plan view to divide the inlet opening (60) into a first inlet opening (61) and a second inlet opening (62) in plan view. The first inlet opening (61) is located more inward than the lower edge of the plate member (53). The second inlet opening (62) is located more outward than the lower edge of the plate member (53). The inner peripheral edge of the inlet opening (60) corresponds to the outer peripheral edge of the grille (52). The outer peripheral edge of the inlet opening (60) corresponds to the opening edge of the air inlet (51*a*).

Suspending Support

Figure 5:
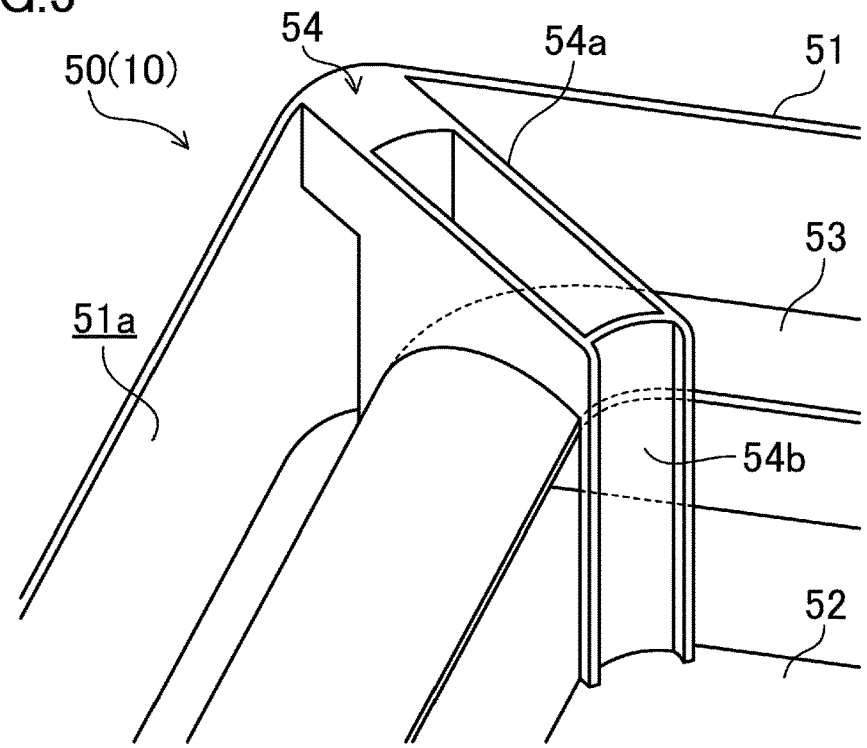
FIG. 5 is a partial perspective view illustrating a main part of the decorative panel according to the embodiment 1.
Figure 6:
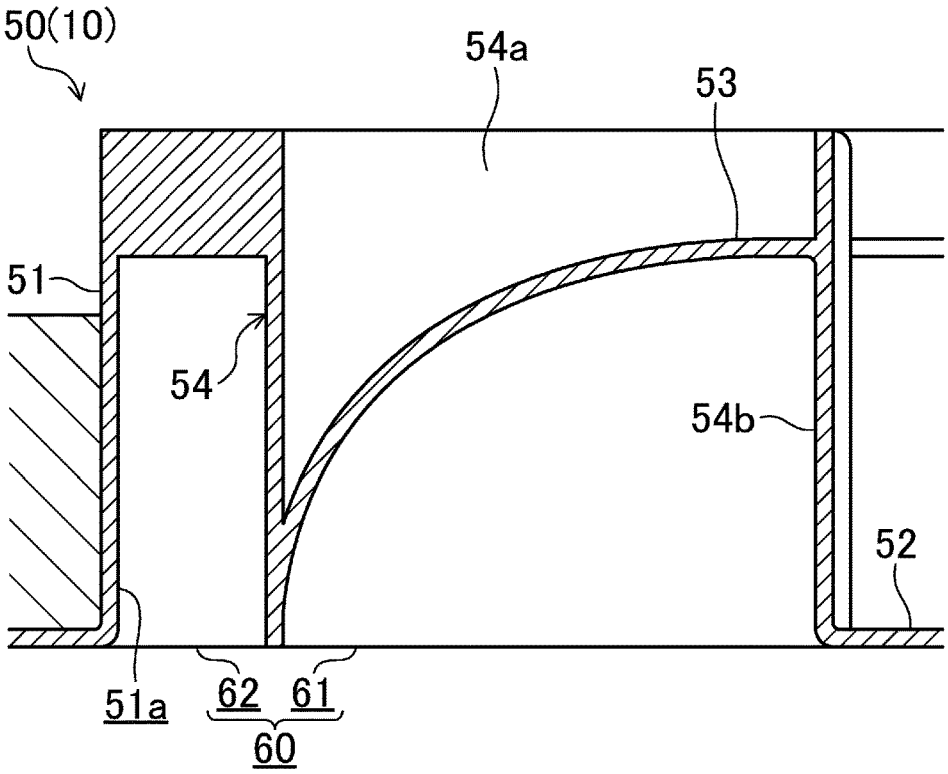
FIG. 6 is a partial longitudinal sectional view illustrating the main part of the decorative panel according to the embodiment 1.

As shown in FIGS. 1 to 6, the four suspending supports (54) are provided inside the air inlet (51*a*), suspend the grille (52), and support the plate member (53). Specifically, each suspending support (54) includes a first extension (54*a*) and a second extension (54*b*). FIG. 5 is an enlarged partial perspective view of the suspending supports (54) as seen obliquely from above. FIG. 6 is an enlarged partial longitudinal sectional view illustrating the proximity of the suspending supports (54) out of the longitudinal section of the decorative panel (50) taken along the direction in which the first extension (54*a*) of one of the suspending supports (54) extends. FIG. 6 is a partial longitudinal sectional view taken along the line VI-VI of FIG. 4.

The first extension (54*a*) of each suspending support (54) extends inward from an inner peripheral portion of the air inlet (51*a*). The second extension (54*b*) is integral with the first extension (54*a*), and extends downward from the tip portion of the first extension (54*a*). The "inner peripheral portion of the air inlet (51*a*)" is a portion of the panel body (51) forming the air inlet (51*a*) (i.e., surrounding the air inlet (51*a*)). Specifically, the inner peripheral portion of the air inlet (51*a*) includes not only the portion of the panel body (51) corresponding to the inner peripheral surface of the air inlet (51*a*), but also the portion of the panel body (51) continuous with the inner peripheral surface of the air inlet (51*a*) (e.g., the inner peripheral edge of the upper end surface continuous with the upper end of the inner peripheral surface of the air inlet (51*a*)). In this example, the first extension (54*a*) (i.e., the extension) extends inward from the inner peripheral surface of the air inlet (51*a*), and the second extension (54*b*) (the suspender) is integral with the first extension (54*a*) and suspends from the tip portion of the first extension (54*a*).

In this example, the first extension (54*a*) is a plate extending inward from the inner peripheral portion of the air inlet (51*a*). The second extension (54*b*) is a plate extending downward from the tip portion of the first extension (54*a*). Specifically, the first extension (54*a*) of each suspending support (54) includes a pair of plates standing vertically at a distance and extending inward from the inner peripheral surface of the air inlet (51*a*). The second extension (54*b*) of each suspending support (54) is a plate extending vertically. The short directional ends of the second extension (54*b*) are connected to the tip portions of the two plates of the first extension (54*a*) of the suspending support (54).

In this example, each of the four suspending supports (54) is arranged at one of four corners of the grille (52). Specifically, the air inlet (51*a*) has a rectangular shape in plan view. The grille (52) has a rectangular shape in plan view. The first extension (54*a*) of each suspending support (54) extends from one of the corners of the air inlet (51*a*) to the associated one of the corners of the grille (52) in plan view. The lower end of the second extension (54*b*) of each suspending support (54) is connected to the associated one of the corners of the grille (52).

The plate member (53) is connected to the lower portion of the first extension (54*a*) of each of the four suspending supports (54), and disposed inside the air inlet (51*a*). In this example, the lower portion of the first extension (54*a*) of each of the four suspending supports (54) is connected to one of four corners of the plate member (53), which is like a frame with a square transverse section.

The lower portion of the first extension (54*a*) of each suspending support (54) has a shape corresponding to the shape of the outer peripheral surface of the plate member (53). The outer peripheral surface of the plate member (53) is connected to the lower portion of the first extension (54*a*). In this example, the lower portion of the first extension (54*a*) of each suspending support (54) has an arc shape to be recessed from the outer peripheral edge of the grille (52). The outer peripheral surface of the plate member (53) is fitted in and connected to the lower portion of the first extension (54*a*).

In this example, a part of the panel body (51) (specifically, the portion near the air inlet (51*a*)), the grille (52), the plate member (53), and the four suspending supports (54) are formed integrally.

Filter

As shown in FIGS. 1 to 4, the filter (55) is provided above the air inlet (51*a*) of the panel body (51), and catches dust in the air, which has passed through the air inlet (51*a*). The filter (55) is a square lattice in plan view, and attached above the central portion of the panel body (51) to cover the air inlet (51*a*).

In this example, the area of the filter (55) is equal to the opening area of the upper end of the air inlet (51*a*) in plan view. However, the area of the filter (55) may be larger than the opening area of the upper end of the air inlet (51*a*) in plan view.

Air Flow Direction Control Vane

As shown in FIGS. 1 to 4, each of the air flow direction control vanes (56) is provided at the lower end portion of each of the four air outlets (51*b*) of the panel body (51) to control the direction of the air flowing through the air outlets (51*b*). Each air flow direction control vane (56) is a plate extending along the length of the associated one of the air outlets (51*b*), and provided with a rocking shaft at each of two longitudinal ends. Each air flow direction control vane (56) is supported by the panel body (51) to be rockable about the rocking shaft.

Detail of Main Part of Decorative Panel

Figure 7:
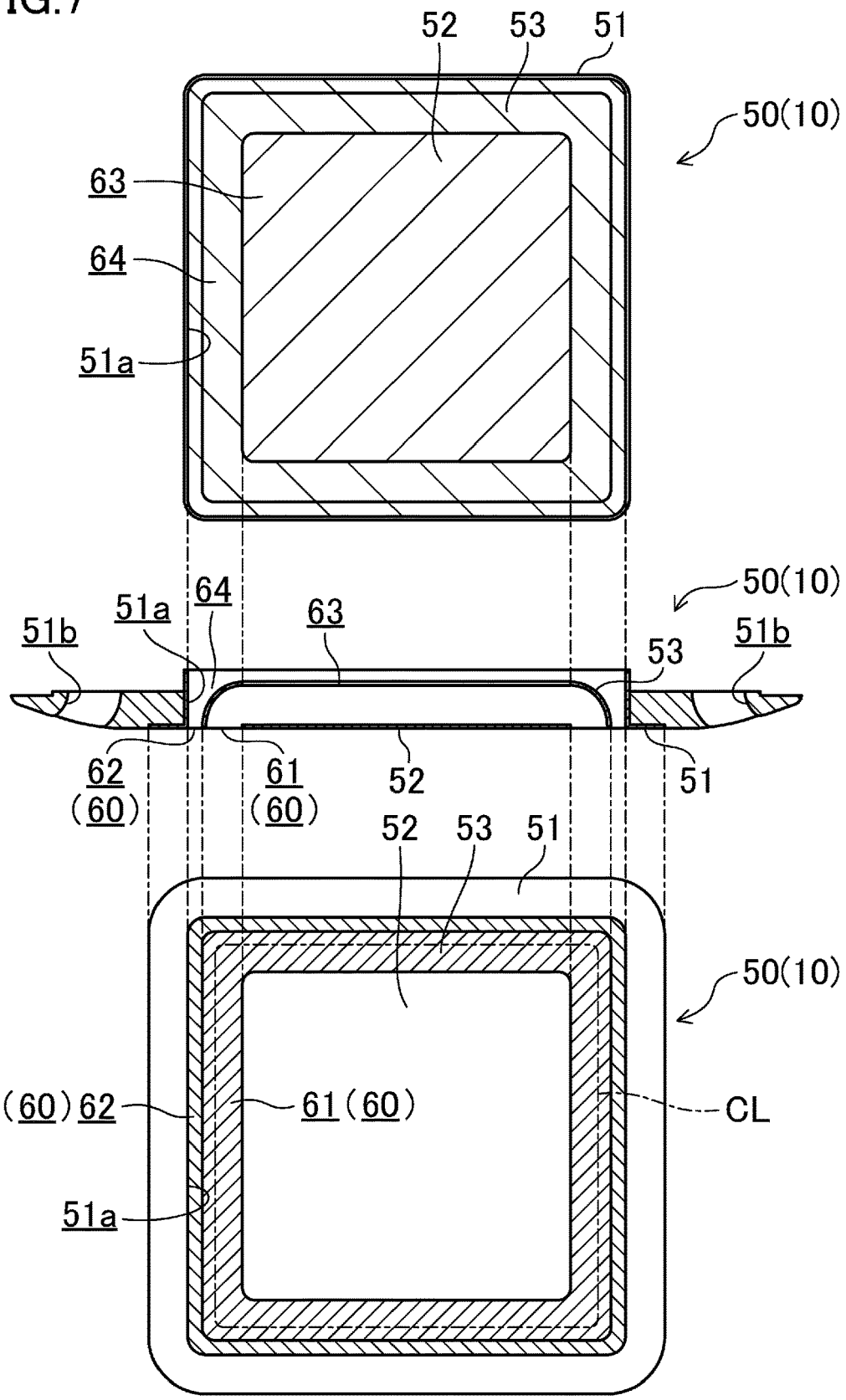
FIG. 7 illustrates in detail, the main part of the decorative panel according to the embodiment 1.

The main part of the decorative panel (50) will now be described in detail with reference to FIG. 7. The center of FIG. 7 illustrates a longitudinal section of the decorative panel (50). The top of FIG. 7 illustrates the main part of the decorative panel (50) (near the air inlet (51*a*)) as seen from above. The bottom of FIG. 7 illustrates the main part of the decorative panel (50) as seen from below. The center of FIG. 7 does not show the suspending supports (54), the filter (55), or the air flow direction control vanes (56).

Opening Area of Inlet Opening

As shown in the bottom of FIG. 7, the first inlet opening (61) has a larger opening area than the second inlet opening (62). In FIG. 7, the first inlet opening (61) is indicated by narrow hatching from bottom left to top right, and the second inlet opening (62) is indicated by narrow hatching from top left to bottom right.

Opening Area of Opening

As shown in the top of FIG. 7, the first opening (63) has a larger opening area than the second opening (64). The first opening (63) is the region surrounded by the upper edge of the plate member (53). The second opening (64) is, in plan view, interposed between the upper edge of the plate member (53) and the inner peripheral surface of the air inlet (51*a*). In FIG. 7, the first opening (63) is indicated by wide hatching from bottom left to top right, and the second opening (64) is indicated by wide hatching from top left to bottom right.

Ratio of Opening Area

The ratio of the opening area of the first inlet opening (61) to the second inlet opening (62) is higher than the ratio of the opening area of the first opening (63) to the second opening (64). The ratio of the opening area of the first inlet opening (61) to the second inlet opening (62) may be equal to the ratio of the opening area of the first opening (63) to the second opening (64).

Position of Lower Edge of Plate Member

As shown in the center of FIG. 7, the lower edge of the plate member (53) is at the same height as the lower end of the air inlet (51*a*). The lower edge of the plate member (53) may be higher than the lower end of the air inlet (51*a*). In this example, as shown in the bottom of FIG. 7, the lower edge of the plate member (53) is, in plan view, located more outward than the center line (CL) between the inner and outer peripheral edges of the inlet opening (60). In this example, as shown in the center of FIG. 7, the lower edge of the plate member (53) is at the same height as the lower surface of the grille (52). The lower edge of the plate member (53) may be higher than the lower surface of the grille (52).

The state that "the lower edge of the plate member (53) is at the same height as the lower end of the air inlet (51*a*) (or the lower surface of the grille (52)) includes not only the state that the lower edge of the plate member (53) is at exactly the same height as the lower end of the air inlet (51*a*) (or the lower surface of the grille (52)) (e.g., there is no difference in height), but also the state that the lower edge of the plate member (53) is at substantially the same height as the lower end of the air inlet (51*a*) (or the lower surface of the grille (52)) (e.g., there is a difference in height within 5 mm).

Position of Upper Edge of Plate Member

As shown in the top and center of FIG. 7, the upper edge of the plate member (53) overlaps the outer peripheral edge of the grille (52) in plan view. The upper edge of the plate member (53) may be located more inward than the outer peripheral edge of the grille (52) in plan view.

Appearance of Indoor Unit

The appearance of the indoor unit (10) as seen from below will now be described. As shown in FIG. 2, the plate member (53) is disposed inside the air inlet (51*a*) such that the upper edge of the plate member (53) is located more inward than the lower edge of the plate member (53). As shown in FIG. 3, when the indoor unit (10) provided in the ceiling (CE) is seen from below, inner parts of the indoor unit (10) (i.e., the filter (55) in this example) are less visible through the inlet opening (60).

In this example, in plan view, the upper edge of the plate member (53) overlaps the outer peripheral edge of the grille (52), and the lower edge of the plate member (53) is, in plan view, interposed between the inner and outer peripheral edges of the inlet opening (60). Thus, when the indoor unit (10) is seen from below, the filter (55) is partially visible in the region (i.e., the second inlet opening (62)) of the inlet opening (60) located more outward than the lower edge of the plate member (53) in plan view, but the rest of the filter (55) is hidden by the plate member (53) in the region (i.e., the first inlet opening (61)) of the inlet opening (60) located more inward than the lower edge of the plate member (53) in plan view.

Air Flow in Indoor Unit

Figure 8:
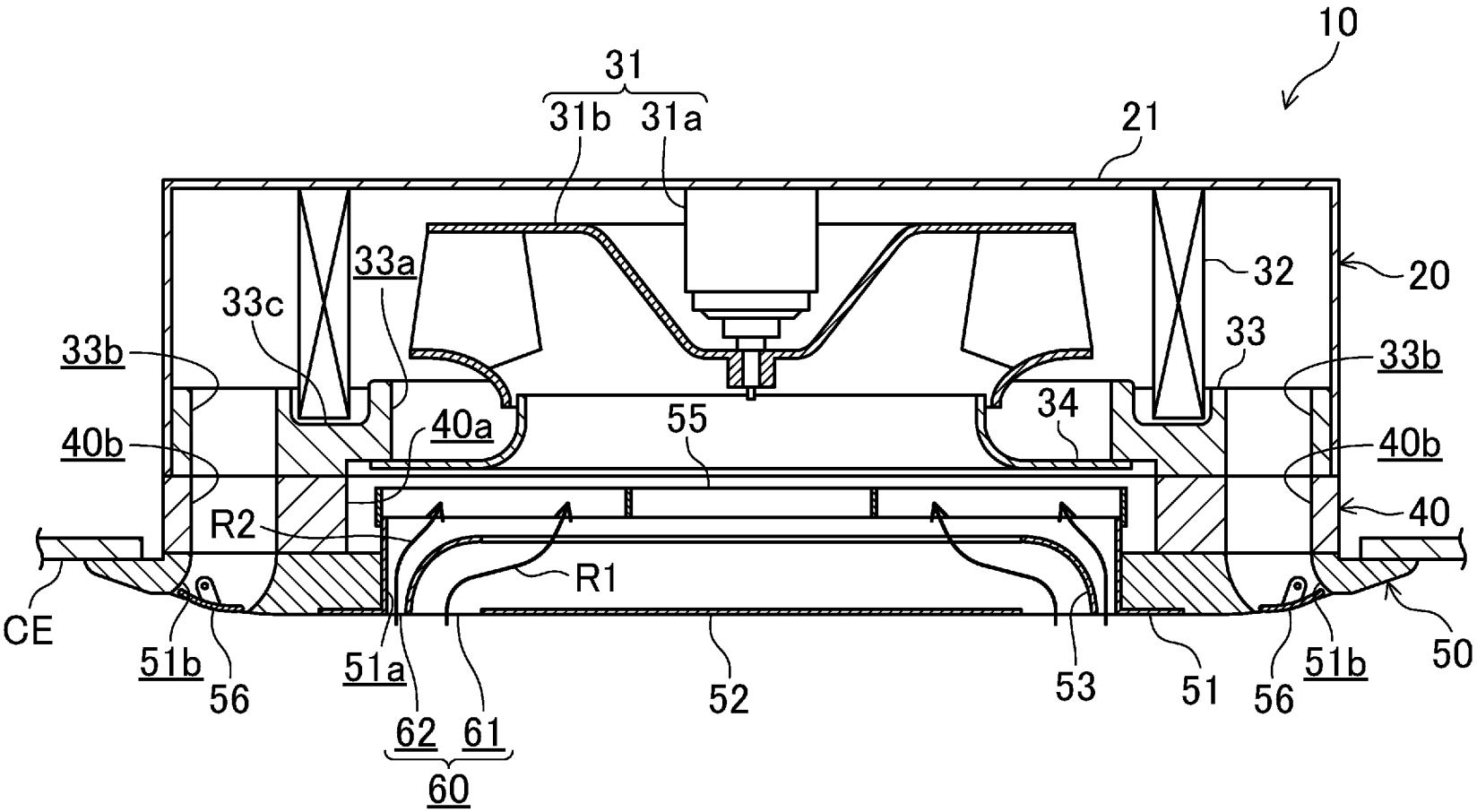
FIG. 8 is a longitudinal sectional view illustrating air flow in the indoor unit.

The air flow in the indoor unit (10) will now be described with reference to FIG. 8. FIG. 8 does not show the suspending supports (54).

When the indoor fan (31) operates, indoor air is sucked from the inlet opening (60) to the air inlet (51*a*). At the air inlet (51*a*), the indoor air, which has been sucked from the inlet opening (60), is branched at the lower edge of the plate member (53) into the inner and outer sides of the plate member (53). The indoor air is divided into the air flowing through the inner side of the plate member (53) and the air flowing through the outer side of the plate member (53). Specifically, a first ventilation path (R1) and a second ventilation path (R2) are provided inside the air inlet (51*a*). In the first ventilation path (R1), the air flows from the inlet opening (60) toward the upper end of the air inlet (51*a*) through the inner side of the plate member (53). In the second ventilation path (R2), the air flows from the inlet opening (60) toward the upper end of the air inlet (51*a*) through the outer side of the plate member (53).

In the first ventilation path (R1), the air, which has flowed to the inner side of the plate member (53), is guided along the inner peripheral surface of the plate member (53) toward the center of the air inlet (51*a*), and flows toward the upper end of the air inlet (51*a*). The air, which has passed through the first ventilation path (R1), passes through the central portion of the filter (55) and then through the bell mouth (34) to be sucked into the indoor fan (31).

On the other hand, in the second ventilation path (R2), the air, which has flowed to the outer side of the plate member (53) passes between the outer peripheral surface of the plate member (53) and the inner peripheral surface of the air inlet (51*a*) toward the upper end of the air inlet (51*a*) without changing the flow direction largely with the plate member (53). The air, which has passed through the second ventilation path (R2), passes through the peripheral edge portion (the portion around the central portion) of the filter (55) and then through the bell mouth (34) to be sucked into the indoor fan (31).

The air sucked into the indoor fan (31) is blown radially outward from the sides of the indoor fan (31). The air blown out of the indoor fan (31) exchanges heat with refrigerant flowing through the indoor heat exchanger (32), when passing through the indoor heat exchanger (32). The air, which has passed through the indoor heat exchanger (32), is branched into the four air outlets (33*b*) and flow downward through the four air outlets (33*b*). The air, which has passed through the four air outlets (33*b*), sequentially passes through the four inlet openings (40*a*) and the four air outlets (51*b*) and is blown into the room.

Advantages of Embodiment 1

As described above, the plate member (53) is provided as follows. The upper edge of the plate member (53) is located more inward than the lower edge of the plate member (53). The upper edge of the plate member (53) is located above the lower end of the air inlet (51*a*). The lower edge of the plate member (53) surrounds the outer periphery of the grille (52) in plan view. This configuration secures the opening area of the inlet opening (60), and makes the inner parts of the indoor unit (10) (i.e., the filter (55) in this example) less visible through the inlet opening (60). This reduces an increase in the ventilation resistance at the inlet opening (60), and improves the design of the decorative panel (50).

The plate member (53) is provided such that the upper edge of the plate member (53) is located more inward than the lower edge of the plate member (53). This configuration guides the air flowed to the inner side of the plate member (53) toward the center of the air inlet (51*a*). This accelerates the air flowing through the central portion (i.e., the central portion in plan view) of the air inlet (51*a*).

In general, the inlet of the indoor fan (31) is often disposed at the central portion of the indoor unit body (20) (at the central portion of the air inlet (33*a*) of the drain pan (33) in this example) in plan view. Thus, the acceleration of the air flowing through the central portion of the air inlet (51*a*) accelerates the air sucked into the indoor fan (31) in the indoor unit body (20). As a result, the efficiency in sucking the air in the indoor unit body (20) improves.

The plate member (53) curves to be recessed from the outer peripheral edge of the grille (52). This secures a longer distance between the plate member (53) and the grille (52) than in the case where the plate member (53) curves to be raised toward the outer peripheral edge of the grille (52). This reduces the ventilation resistance on the inner side of the plate member (53), and smoothens the air flowing through the inner side of the plate member (53). As a result, the air flowing through the central portion of the air inlet (51*a*) is accelerated.

The plate member (53) is provided such that the lower edge of the plate member (53) divides the inlet opening (60) into the first inlet opening (61) and the second inlet opening (62) in plan view. With this configuration, in addition to the first ventilation path (R1) passing through the inner side of the plate member (53), the second ventilation path (R2) passing through the outer side of the plate member (53) is provided inside the air inlet (51*a*). In the second ventilation path (R2), the air, which has flowed to the outer side of the plate member (53), flows toward the upper end of the air inlet (51*a*) without changing the flow direction largely with the plate member (53). That is, the second ventilation path (R2) has a lower ventilation resistance than the first ventilation path (R1). Thus, the provision of the second ventilation path (R2) in addition to the first ventilation path (R1) inside the air inlet (51*a*) reduces more ventilation resistance at the air inlet (51*a*) than in the case where the air sucked from the inlet opening (60) passes only through the inner side of the plate member (53) (i.e., only the first ventilation path (R1) is provided), and thus smoothens the air flowing through the air inlet (51*a*).

Reduction in the ventilation resistance at the air inlet (51*a*) reduces workload (specifically, the number of rotation of the indoor fan (31)) required to suck air at the indoor unit body (20). As a result, noise in the indoor unit (10) (specifically, operating noise of the indoor fan (31)) decreases.

The plate member (53) is provided such that the lower edge of the plate member (53) divides the inlet opening (60) into the first inlet opening (61) and the second inlet opening (62) in plan view. Then, the first and second ventilation paths (R1) and (R2) are provided inside the air inlet (51*a*). The air, which has passed through the first ventilation path (R1), is fed to the central portion of the filter (55). The air, which has passed through the second ventilation path (R2), is fed to a peripheral edge portion of the filter (55) (for example, the portion hidden by the plate member (53) when the indoor unit (10) is seen from below). Therefore, not only the central portion of the filter (55) but also the peripheral edge portion of the filter (55) can be utilized efficiently.

The first inlet opening (61) has a larger opening area than the second inlet opening (62) so that the ventilation resistance at the entrance of the first ventilation path (R1) is lower than the ventilation resistance at the entrance of the second ventilation path (R2). This accelerates the air flowing into the first ventilation path (R1), and thus accelerates the air flowing through the central portion of the air inlet (51*a*).

The first opening (63) has a larger opening area than the second opening (64) so that the ventilation resistance at the exit of the first ventilation path (R1) is lower than the ventilation resistance at the exit of the second ventilation path (R2). This accelerates the air flowing out of the first ventilation path (R1), and thus accelerates the air flowing through the central portion of the air inlet (51*a*).

In addition, the ratio of the opening area of the first inlet opening (61) to the second inlet opening (62) is higher than or equal to the ratio of the opening area of the first opening (63) to the second opening (64). This configuration smoothens more air flowing through the first ventilation path (R1) than the other configuration (i.e., in which the ratio of the opening area of the first inlet opening (61) to the second inlet opening (62) is lower than the ratio of the opening area of the first opening (63) to the second opening (64)). This accelerates the air flowing through the central portion of the air inlet (51*a*).

The lower edge of the plate member (53) is at the same height as or higher than the lower end of the air inlet (51*a*). This configuration makes the plate member (53) less conspicuous than the configuration in which the lower edge of the plate member (53) protrudes downward beyond the air inlet (51*a*). This improves the design of the decorative panel (50).

The plate member (53) is provided such that the lower edge of the plate member (53) is located more outward than the center line (CL) between the inner and outer peripheral edges of the inlet opening (60) in plan view. This configuration reduces a gap between the outer peripheral edge of the inlet opening (60) and the lower edge of the plate member (53) than the configuration in which the lower edge of the plate member (53) is located more inward than the center line (CL) in plan view. This makes the inner parts of the indoor unit (10) less visible through the inlet opening (60), and thus improves the design of the decorative panel (50).

The plate member (53) is provided such that the upper edge of the plate member (53) overlaps the outer peripheral edge of the grille (52) or is located more inward than the outer peripheral edge of the grille (52) in plan view. This configuration makes the inner parts of the indoor unit (10) less visible in the region of the inlet opening (60) more inward than the lower edge of the plate member (53), when the indoor unit (10) is seen in plan view from the bottom. This improves the design of the decorative panel (50).

The lower portion of the first extension (54*a*) of each suspending support (54) has a shape corresponding to the outer peripheral surface of the plate member (53) to be connected to the outer peripheral surface of the plate member (53). This configuration increases the connecting area between the suspending supports (54) and the plate member (53). This increases the connecting strength between the suspending supports (54) and the plate member (53), thereby reinforcing the support of the plate member (53) using the suspending supports (54).

The grille (52) is provided such that the lower surface of the grille (52) is at the same height as the lower end of the air inlet (51*a*). This configuration improves integration (feeling of flatness) between the panel body (51) and the grille (52) more than the configuration in which the grille (52) protrudes below the panel body (51). This improves the design of the decorative panel (50).

The first extension (54*a*) of each suspending support (54) is a plate standing vertically. This configuration reduces an increase in the ventilation resistance caused by the arrangement of the suspending supports (54). This smoothens the air flowing through the air inlet (51*a*).

Variation of Plate Member

Figure 9:
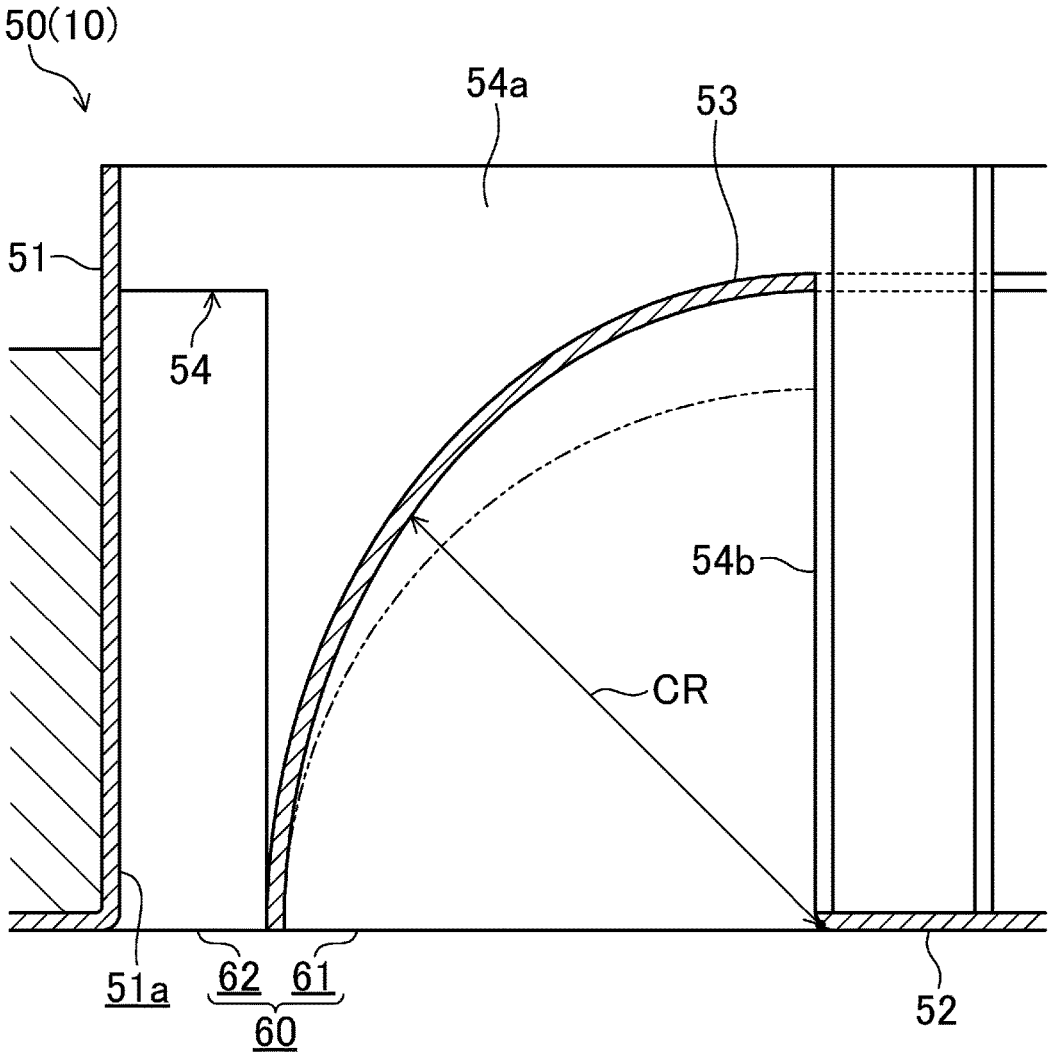
FIG. 9 is a partial longitudinal sectional view of a variation 1 of the plate member.

As shown in FIG. 9, the plate member (53) may be configured such that the curvature radius (CR) of the plate member (53) having the curvature center at the outer peripheral edge of the grille (52) gradually increases from the lower edge toward the upper edge of the plate member (53). In FIG. 9, a chain double-dashed line represents the inner peripheral surface of the plate member (53) where the plate member (53) has a uniform curvature radius from the upper edge toward the lower edge of the plate member (53).

With the foregoing configuration, the distance between the plate member (53) and the grille (52) gradually increases from the lower edge toward the upper edge of the plate member (53). This gradually reduces the ventilation resistance on the inner side of the plate member (53) from the lower edge toward the upper edge of the plate member (53), and smoothens the air flowing through the inner side of the plate member (53) (i.e., the air flowing through the first ventilation path (R1)). This accelerates the air flowing through the central portion of the air inlet (51*a*).

Other Variation of Plate Member

Figure 10:
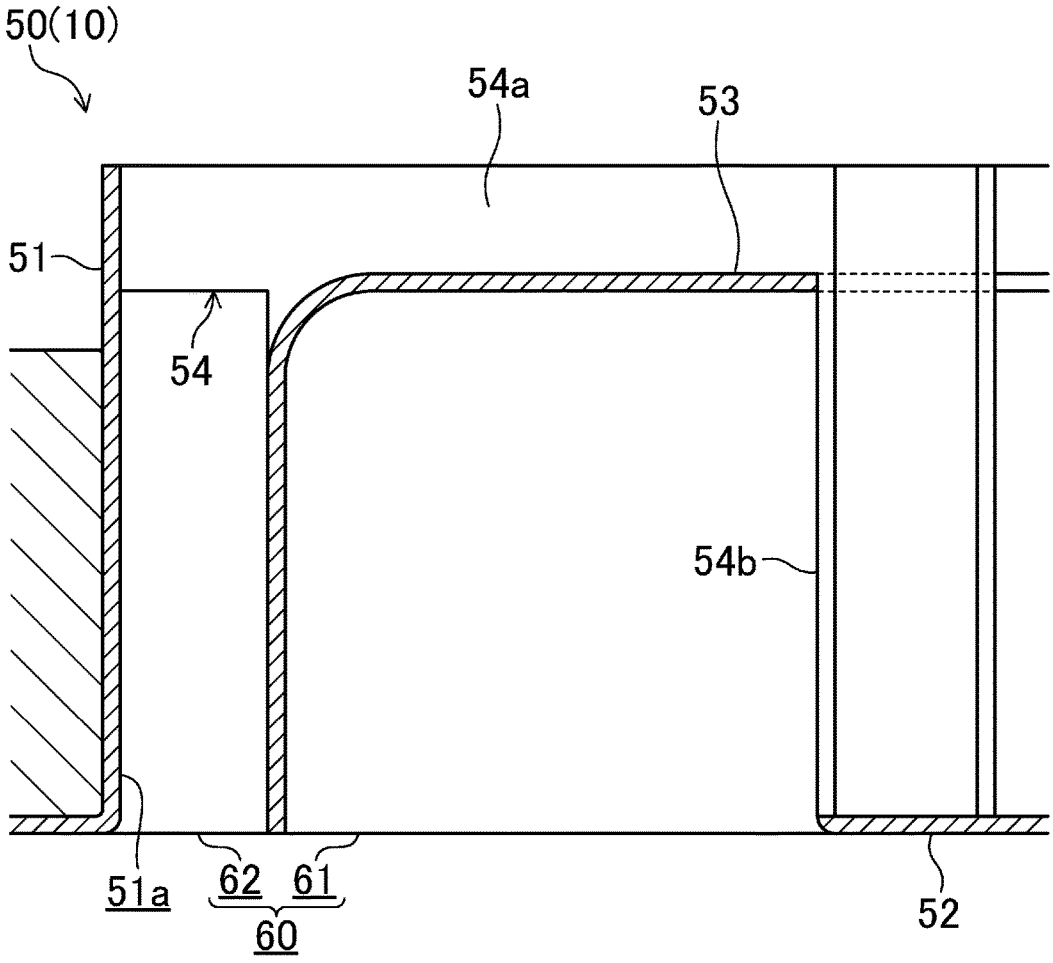
FIG. 10 is a partial longitudinal sectional view of a variation 2 of the plate member.
Figure 11:
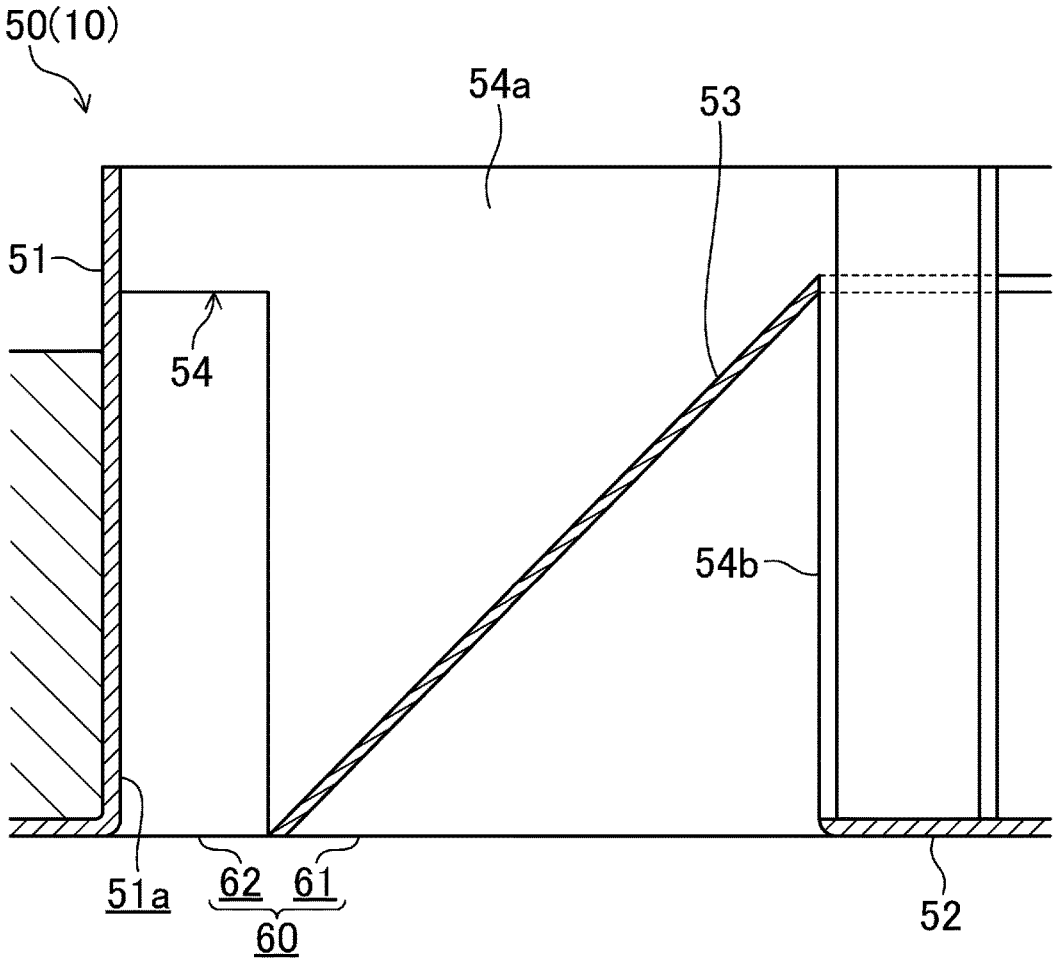
FIG. 11 is a partial longitudinal sectional view of a variation 3 of the plate member.

As shown in FIG. 10, the plate member (53) may curve (or bend) in an L-shape to be recessed from the outer peripheral edge of the grille (52). As shown in FIG. 11, the plate member (53) may be inclined upward in a line from the outer periphery toward the inside of the air inlet (51*a*).

This configuration also guides the air flowed to the inner side of the plate member (53) toward the center of the air inlet (51*a*), thereby accelerating the air flowing through the central portion of the air inlet (51*a*).

In the case where the plate member (53) curves to be recessed from the outer peripheral edge of the grille (52) (FIGS. 2, 9, and 10), a longer distance is secured between the plate member (53) and the grille (52) than in the case where the plate member (53) is inclined upward in a line from the outer periphery toward the inside of the air inlet (51*a*) (FIG. 11).

Variation of Decorative Panel

Figure 12:
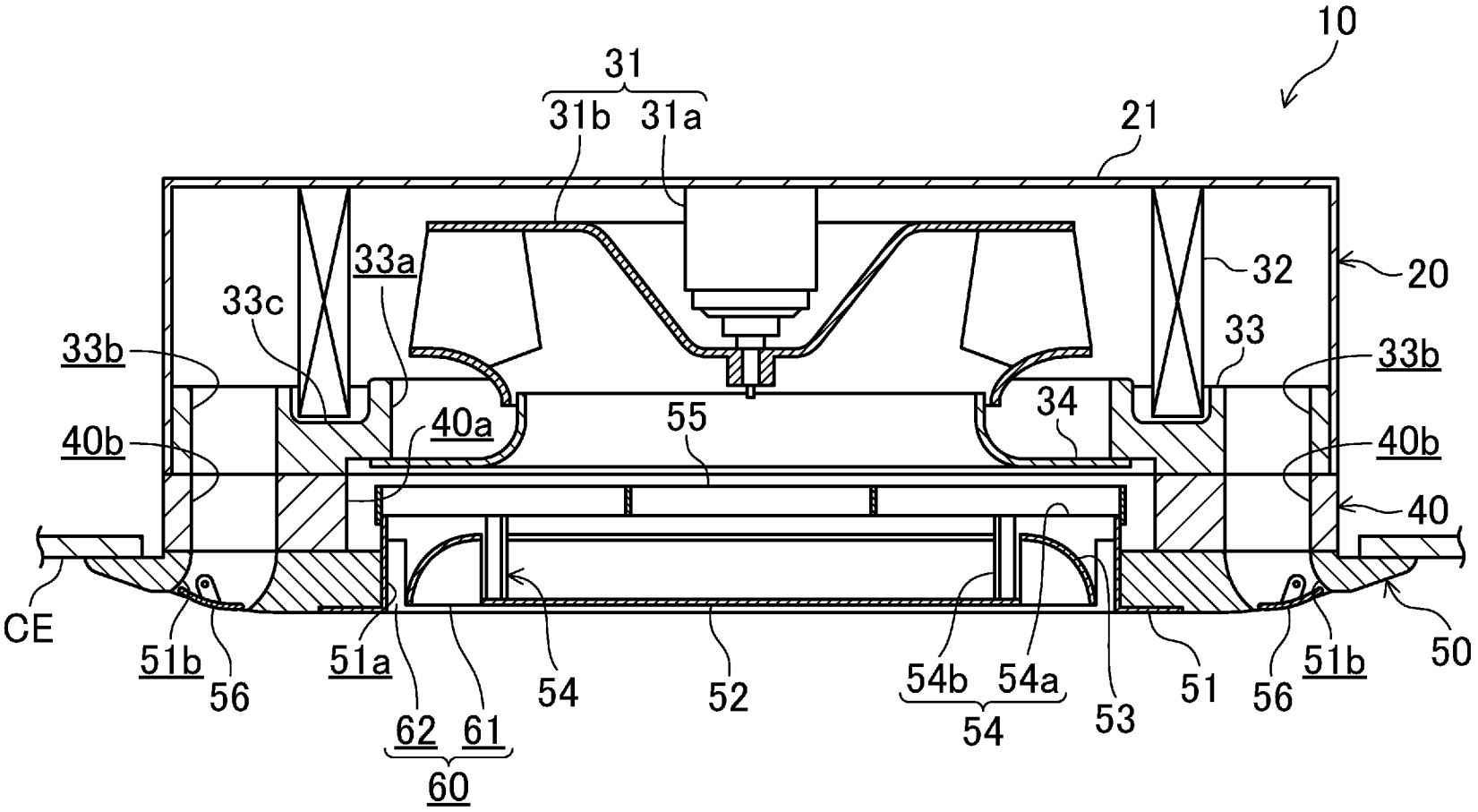
FIG. 12 is a longitudinal sectional view of a variation of the decorative panel.

As shown in FIG. 12, the grille (52) may be provided at the lower end portion of the air inlet (51*a*) such that the lower surface of the grille (52) is higher than the lower end of the air inlet (51*a*). In this example, the grille (52) has a flat lower surface, which is parallel to the lower surface of the panel body (51).

This configuration also improves the integration between the panel body (51) and the grille (52) as compared to the case where the grille (52) protrudes below the panel body (51).

Variation of Suspending Support

Figure 13:
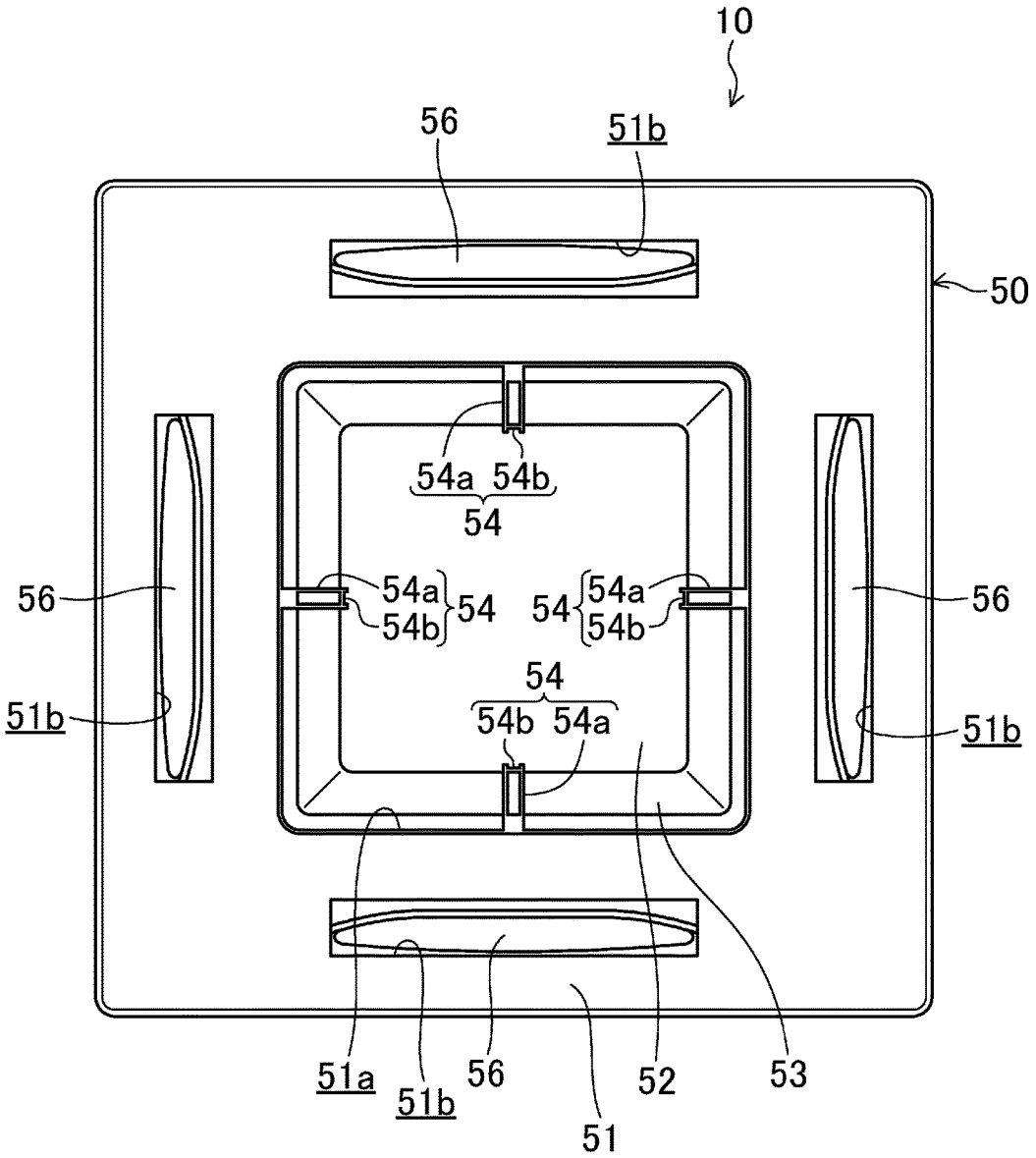
FIG. 13 is a top view of a variation of the suspending support.

As shown in FIG. 13, each of the four suspending supports (54) may be arranged on one of four sides of the grille (52) (e.g., at the center of the side in this example). In this example, the air inlet (51*a*) has a rectangular shape in plan view, and the grille (52) has a rectangular shape in plan view. The first extension (54*a*) of each suspending support (54) extends from a side of the air inlet (51*a*) to a side of the grille (52) in plan view. The lower end of the second extension (54*b*) of each suspending support (54) is connected to the associated one of the sides of the grille (52). This configuration also suspends the grille (52) and supports the plate member (53).

Embodiment 2

Figure 14:
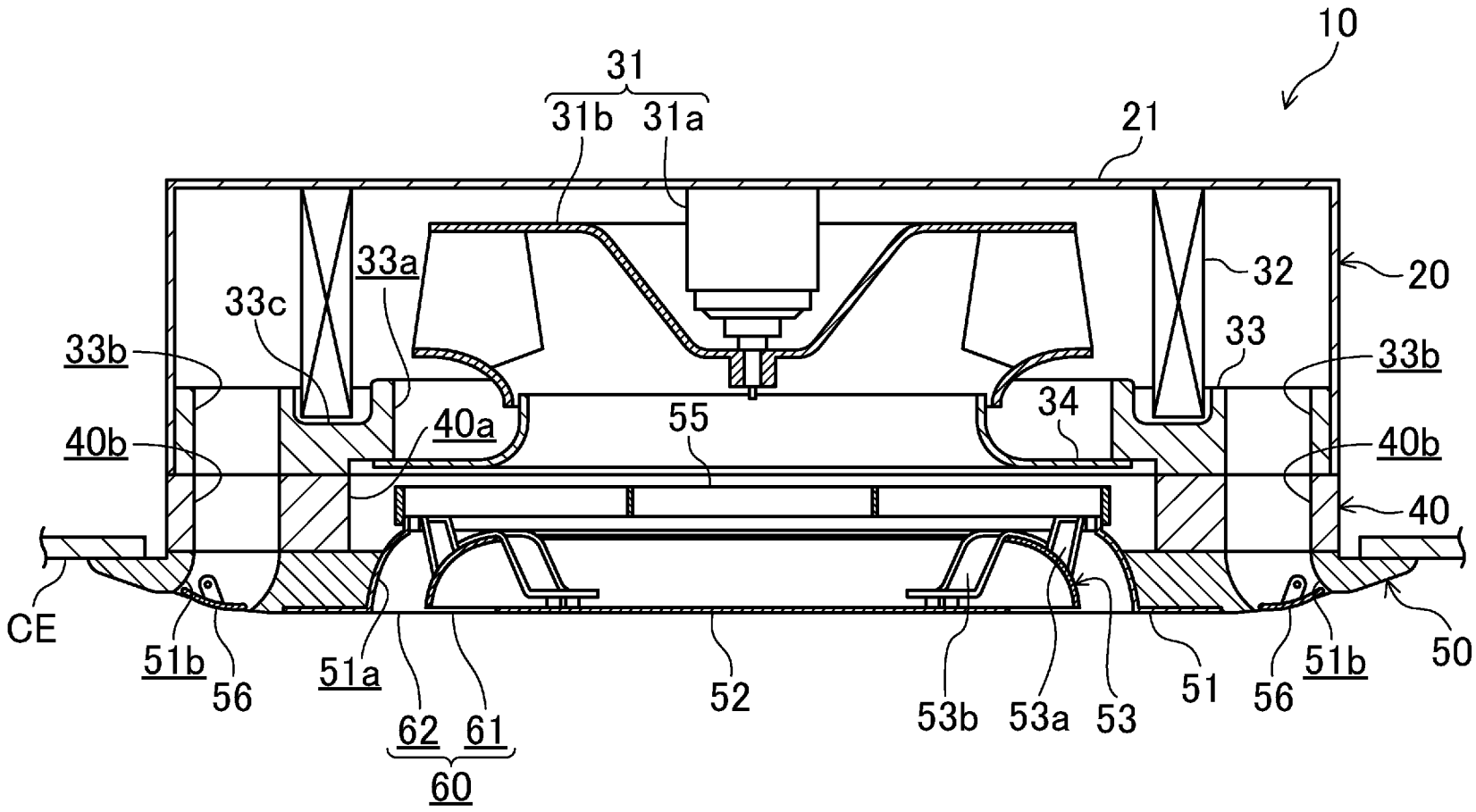
FIG. 14 is a longitudinal sectional view illustrating an exemplary configuration of an indoor unit for an air conditioner according to an embodiment 2.

FIG. 14 illustrates an exemplary configuration of an indoor unit (10) of an air conditioner according to an embodiment 2. The decorative panel (50) of the indoor unit (10) of the embodiment 2 has a different configuration from that of the embodiment 1. The other configurations are similar to that of the embodiment 1. FIG. 14 is a longitudinal sectional view of the indoor unit (10) of the embodiment 2, and corresponds to the longitudinal sectional view taken along the line II-II of FIG. 3.

Decorative Panel

Figure 15:
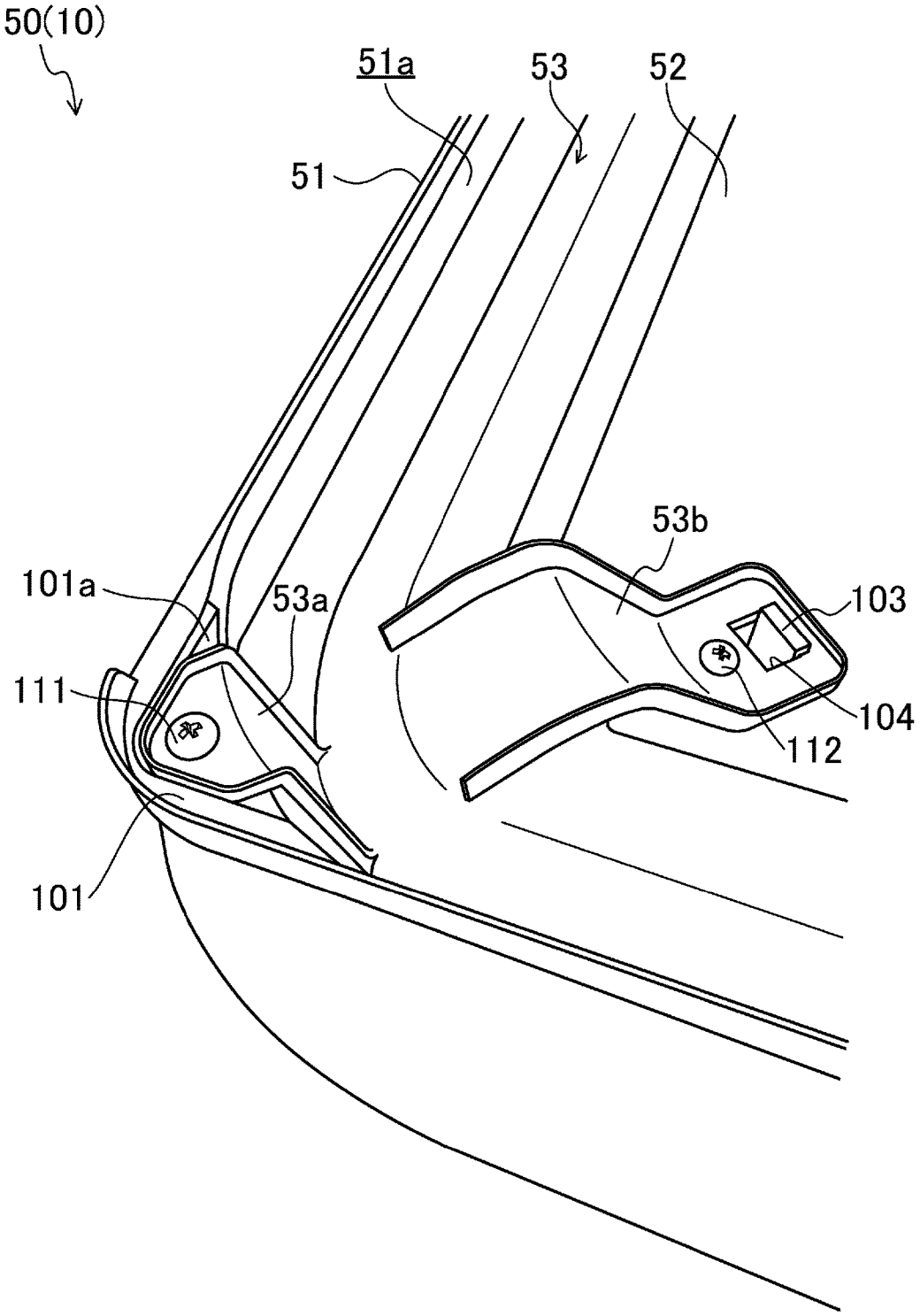
FIG. 15 is a partial perspective view illustrating a main part of a decorative panel according to the embodiment 2.
Figure 16:
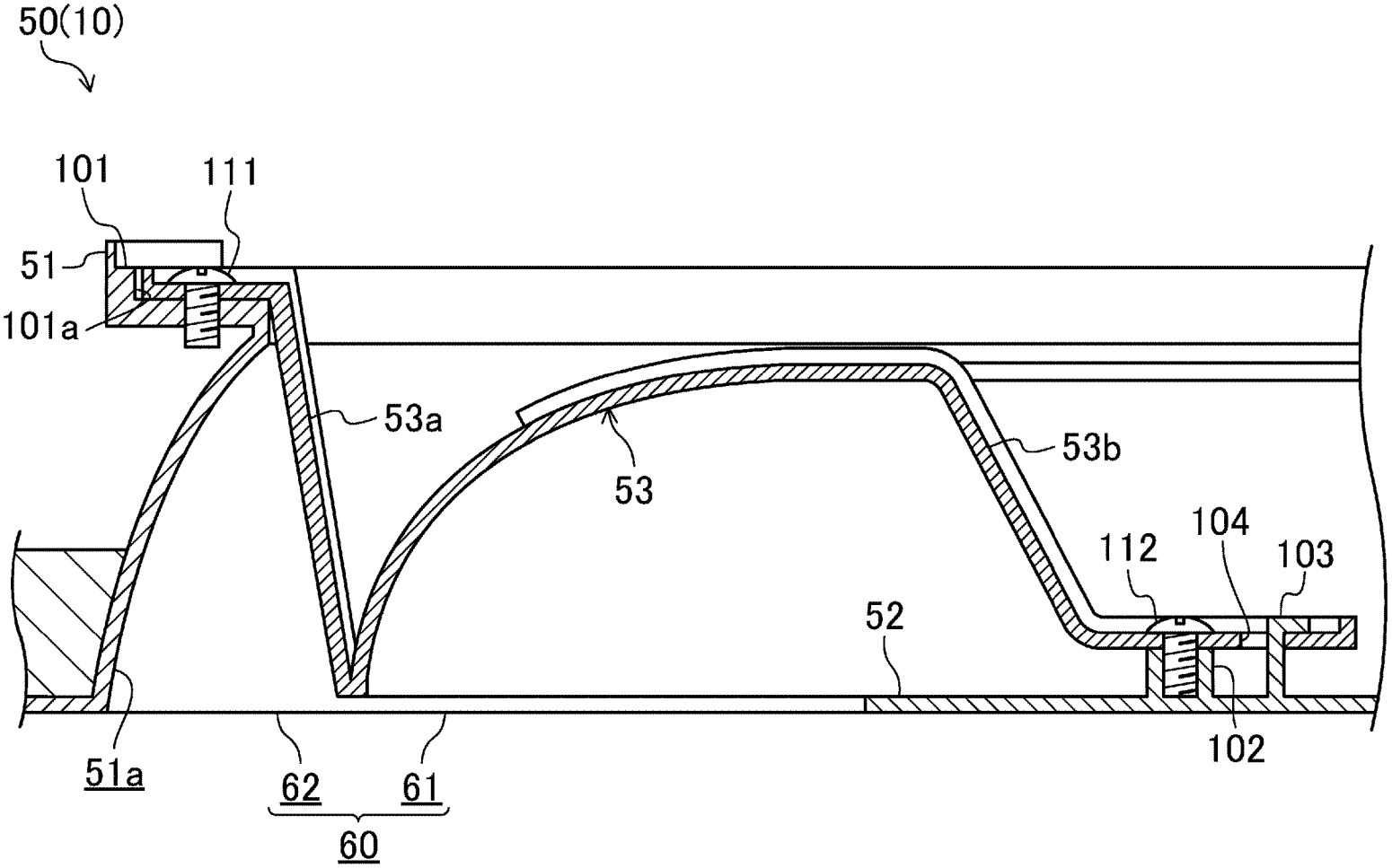
FIG. 16 is a partial longitudinal sectional view illustrating the main part of decorative panel according to the embodiment 2.

As shown in FIGS. 15 and 16, the air inlet (51*a*) of the panel body (51), the grille (52), and the plate member (53) of the decorative panel (50) of the embodiment 2 have different configurations from those of the decorative panel (50) of the embodiment 1. In the decorative panel (50) of the embodiment 2, the suspending supports (54) are replaced with the first and second connecting portions (53*a*, 53*b*) of the plate member (53). The other configurations of the decorative panel (50) of the embodiment 2 are similar to those of the decorative panel (50) of the embodiment 1. FIG. 15 is an enlarged partial perspective view of the main part (i.e., the first and second connecting portions (53*a*, 53*b*)) of the plate member (53) as seen obliquely from above. FIG. 16 is an enlarged partial longitudinal sectional view illustrating the main part of the plate member (53) of the longitudinal section of the decorative panel (50) along the direction in which the first connecting portion (53*a*) of the plate member (53) projects. FIG. 16 corresponds to the longitudinal sectional view taken along the line VI-VI of FIG. 4.

Panel Body

The air inlet (51*a*) of the panel body (51) is configured such that the opening area gradually increases from its upper end to its lower end. The inner peripheral surface of the air inlet (51*a*) curved to be recessed from the outer peripheral edge of the grille (52).

A fixing platform (101) is provided for each upper end corner (i.e., each corner in plan view) of the inner peripheral surface of the air inlet (51*a*). The fixing platform (101) is a triangular plate projecting outward from the upper end corner of the inner peripheral surface of the air inlet (51*a*). That is, the fixing platform (101) is continuous with the inner peripheral surface of the air inlet (51*a*). The fixing platform (101) has a recess (101*a*). The recess (101*a*) is recessed downward so as to receive the tip portion of the first connecting portion (53*a*) of the plate member (53).

In this example, the lower surface of the grille (52) is at the same height as the lower end of the inner peripheral surface of the air inlet (51*a*). The lower edge of the plate member (53) is higher than the lower end of the inner peripheral surface of the air inlet (51*a*). The upper end of the inner peripheral surface of the air inlet (51*a*) is located more outward than the lower edge of the plate member (53), in plan view.

Grille

A projection (102) and a locking hook (103) are provided at each corner of the grille (52). The projection (102) projects upward from the grille (52). The locking hook (103) is located more inward than the projection (102). The locking hook (103) projects upward from the grille (52). The tip portion of the locking hook (103) bends in an L-shape toward the inside of the air inlet (51*a*) to be engaged with a locking hole (104), which will be described later.

Plate Member

The plate member (53) includes the first and second connecting portions (53*a*, 53*b*). The first connecting portion (53*a*) is connected to the panel body (51) by screwing. The second connecting portion (53*b*) is connected to the grille (52) by hooking and screwing.

First Connecting Portion

The first connecting portion (53*a*) extends toward the inside of the air inlet (51*a*)(in this example, the fixing platform (101) of the air inlet (51*a*)) to be connected to an inner peripheral portion of the air inlet (51*a*). In this example, the first connecting portion (53*a*) is a plate extending from the lower edge portion of the plate member (53) toward the recess (101*a*) of the fixing platform (101). Specifically, the first connecting portion (53*a*) extends obliquely upward from the lower edge portion of the plate member (53) toward the recess (101*a*) of the fixing platform (101). The tip portion (i.e., the upper end) of the first connecting portion (53*a*) bends in the L-shape along the bottom of the recess (101*a*). In this example, the tip portion of the first connecting portion (53*a*) has a triangular shape in plan view. The recess (101*a*) of the fixing platform (101) has a shape corresponding to the shape (specifically, the triangular shape) of the tip portion of the first connecting portion (53*a*).

The first connecting portion (53*a*) is fixed and connected to the fixing platform (101) by a first fixing screw (111) with its tip portion received by the recess (101*a*) of the fixing platform (101). The first fixing screw (111) penetrates the tip portion of the first connecting portion (53*a*) received by the recess (101*a*) of the fixing platform (101) and is engaged to the bottom of the recess (101*a*) of the fixing platform (101).

Second Connecting Portion

The second connecting portion (53*b*) extends to the grille (52) to be connected to the grille (52). In this example, the second connecting portion (53*b*) is a plate extending downward from the upper edge of the plate member (53) toward the inside of the air inlet (51*a*). The tip portion (i.e., the lower end) of the second connecting portion (53*b*) bends in an L-shape in parallel with the upper surface of the grille (52).

The locking hole (104) is provided in the tip portion of the second connecting portion (53*b*). The locking hole (104) is located in the position corresponding to the locking hook (103) of the grille (52), and vertically penetrates the tip portion of the second connecting portion (53*b*) to be engaged with the locking hook (103) of the grille (52).

The tip portion of the second connecting portion (53*b*) is fixed and connected to the projection (102) of the grille (52) by the second fixing screw (112) with the locking hole (104) of its tip portion engaged with the locking hook (103) of the grille (52). The second fixing screw (112) penetrates the tip portion of the second connecting portion (53*b*) mounted on the projection (102) of the grille (52) and is engaged to the projection (102).

Advantages of Embodiment 2

The foregoing configuration provides advantages similar to those of the embodiment 1. Specifically, the plate member (53) is provided, thereby reducing an increase in the ventilation resistance at the inlet opening (60), and improving the design of the decorative panel (50).

The first and second connecting portions (53*a*, 53*b*) are provided for the plate member (53). The first connecting portion (53*a*) connects the plate member (53) to the inner peripheral portion of the air inlet (51*a*). The second connecting portion (53*b*) connects the plate member (53) to the grille (52). This configuration supports the plate member (53) and the grille (52).

The air inlet (51*a*) is configured such that the opening area of the air inlet (51*a*) gradually increases from its upper end toward its lower end. This configuration increases the opening area of the inlet opening (60), while making the inner parts of the indoor unit (10) (i.e., the filter (55) in this example) less visible through the inlet opening (60). This secures an improved design of the decorative panel (50), and reduces the ventilation resistance at the inlet opening (60).

The second connecting portion (53*b*) is formed to extend obliquely downward from the upper edge portion of the plate member (53) toward the inside of the air inlet (51*a*). This configuration makes the second connecting portion (53*b*) of the plate member (53) less visible through the inlet opening (60) than the configuration in which the second connecting portion (53*b*) extends vertically downward from the upper edge portion of the plate member (53). This improves the design of the decorative panel (50).

The locking hook (103) is provided at the grille (52), and the locking hole (104) is provided in the second connecting portion (53*b*) of the plate member (53). While the grille (52) hooks (i.e., is temporarily fixed to) the plate member (53), the grille (52) and the plate member (53) are connected by screwing. This facilitates the connecting of the grille (52) to the plate member (53) by screwing.

The first connecting portion (53*a*) of the plate member (53) may be connected to the panel body (51) by means (e.g., claw fitting or integral molding) other than screwing. Similarly, the second connecting portion (53*b*) of the plate member (53) may be connected to the grille (52) by means other than screwing.

The upper end of the inner peripheral surface of the air inlet (51*a*) may overlap the lower edge of the plate member (53) in plan view. Alternatively, the upper end of the inner peripheral surface of the air inlet (51*a*) may be located more inward than the lower edge of the plate member (53), in plan view. With this configuration, when the indoor unit (10) mounted in the ceiling (CE) is seen from below, the inner parts of the indoor unit (10) (i.e., the filter (55) in this example) is less visible between the upper end of the inner peripheral surface of the air inlet (51*a*) and the lower edge of the plate member (53). This improves the design of the decorative panel (50).

Other Embodiments

The opening width of the second inlet opening (62) (i.e., the gap between the lower edge of the plate member (53) and the opening edge of the air inlet (51*a*)) is preferably designed not to cause wind noise when air passes through the second inlet opening (62). Specifically, the opening width of the second inlet opening (62) is preferably equal to or more than one-fourth of the opening width of the inlet opening (60) (i.e., the gap between the outer peripheral edge of the grille (52) and the opening edge of the air inlet (51*a*)).

A soundproof member (not shown) may be provided on the upper surface of the grille (52). This configuration reduces downward leakage of sound from the inside of the indoor unit (10), and reduces noise in the indoor unit (10). The soundproof member may be made of a sound-insulating material or a sound absorbing material.

The upper surface of the grille (52) may have a pyramid shape (e.g., a pyramid shape with a square bottom) with a gradually increasing height from the outer peripheral edge to the center of the grille (52). This configuration guides the air, which has been guided by the plate member (53) toward the center of the air inlet (51*a*), toward the upper end of the air inlet (51*a*). This accelerates the air flowing through the central portion of the air inlet (51*a*).

In the above description, an example has been described where the lower surface of the grille (52) is at the same height as or higher than the lower end of the air inlet (51*a*). The lower surface of the grille (52) may be lower than the lower end of the air inlet (51*a*). In this configuration, the plate member (53) is provided to secure the opening area of the inlet opening (60) and make the inner parts of the indoor unit (10) (e.g., the filter (55)) less visible through the inlet opening (60).

In the above description, the lower edge of the plate member (53) divides the inlet opening (60) into the first inlet opening (61) and the second inlet opening (62) in plan view. The lower edge of the plate member (53) does not necessarily divide the inlet opening (60) into the first inlet opening (61) and the second inlet opening (62) in plan view. Specifically, the lower edge of the plate member (53) may be connected to the inner peripheral surface of the air inlet (51*a*). In this case, the lower edge of the plate member (53) overlaps the outer peripheral edge of the inlet opening (60) (i.e., the opening edge of the air inlet (51*a*)) in plan view, and thus, does not divide the inlet opening (60). This configuration also secures the opening area of the inlet opening (60) and makes the inner parts of the indoor unit (10) less visible through the inlet opening (60).

An example has been described where a part (specifically, the part around the air inlet (51*a*)) of the panel body (51), the grille (52), the plate member (53), and the four suspending supports (54) are formed integrally. However, these members may be formed independently from each other.

The plate member (53) may include a plurality of constituent plates arranged along the inner surface of the air inlet (51*a*). For example, the plate member (53) shown in FIG. 4 may include four constituent plates, each extending along one of four inner walls of the air inlet (51*a*). These constituent plates may be arranged along the inner surface of the air inlet (51*a*) at intervals. For example, the plate member (53) may include four constituent plates, each extending along one of the four inner walls of the air inlet (51*a*) so as to form a gap at the associated one of the four corners of the plate member (53) shown in FIG. 4. In this manner, the plate member (53) may extend discontinuously along the inner surface of the air inlet (51*a*). This configuration secures the opening area of the inlet opening (60), and makes the inner parts of the indoor unit (10) less visible through the inlet opening (60).

While an example has been described where the plate member (53) extends continuously along the entire inner surface of the air inlet (51*a*), the plate member (53) may be partially provided along the inner surface of the air inlet (51*a*). This configuration also secures the opening area of the inlet opening (60), and makes the inner parts of the indoor unit (10) less visible through the inlet opening (60).

While an example has been described where the chamber (40) is provided between the indoor unit body (20) and the decorative panel (50), the indoor unit (10) does not necessarily include the chamber (40). In this case, the decorative panel (50) is provided under the indoor unit body (20) (specifically, under the drain pan (33)) such that the air inlet (51*a*) and the air outlets (51*b*) of the decorative panel (50) communicate with the air inlet (33*a*) and the air outlets (33*b*) of the drain pan (33).

The embodiments described above may be combined as appropriate. The above embodiments are merely preferred examples by nature, and are not intended to limit the scope of the present disclosure, equivalents, and their applications.

INDUSTRIAL APPLICABILITY

As described above, the indoor unit is useful as an indoor unit for an air conditioner provided in a ceiling.

DESCRIPTION OF REFERENCE CHARACTERS

10 Indoor Unit
20 Indoor Unit Body
21 Casing
31 Indoor Fan
32 Indoor Heat Exchanger
33 Drain Pan
34 Bell Mouth
40 Chamber
50 Decorative Panel
51 Panel Body
51*a* Air Inlet
51*b* Air Outlet
52 Grille
53 Plate Member
54 Suspending Support
54*b* First Extension
54*b* Second Extension
55 Filter
56 Air Flow Direction Control Vane
60 Inlet Opening
61 First Inlet Opening
62 Second Inlet Opening
63 First Opening
64 Second Opening
CE Ceiling

The invention claimed is:

1. An indoor unit for an air conditioner provided in a ceiling, the indoor unit comprising:
- an indoor unit body, mounted in the ceiling, including a fan and a heat exchanger arranged inside the indoor unit body, and controlling a temperature of air flowing out an outlet port; and
- a decorative panel provided under the indoor unit body, wherein
- the decorative panel includes
  - a panel body vertically penetrated by an air inlet at its central portion, and by air outlets around the air inlet,
  - a grille being a plate provided at a lower end portion of the air inlet, and covering a central portion of the air inlet to form an inlet opening between an outer peripheral edge of the grille and an opening edge of the air inlet in plan view, and
  - an air guide extending along an inner surface of the air inlet, and provided inside the air inlet such that an upper edge of the air guide is located more inward than a lower edge of the air guide,
- the upper edge of the air guide is located above the lower end of the air inlet,
- the lower edge of the air guide surrounds an outer periphery of the grille and is located between inner and outer peripheral edges of the inlet opening in plan view, and divides the inlet opening into a first ventilation path and a second ventilation path, and
- the air guide curves to be recessed from the outer peripheral edge of the grille.

2. The indoor unit of claim 1, wherein
- the first ventilation path is located more inward than the lower edge of the air guide,
- the second ventilation path is located more outward than the lower edge of the air guide, and
- the first ventilation path has a larger inlet opening area than the second ventilation path.

3. The indoor unit of claim 1, wherein a curvature radius of the air guide having a curvature center at the outer peripheral edge of the grille gradually increases from the lower edge toward the upper edge of the air guide.

4. The indoor unit of claim 1, wherein the lower edge of the air guide is located more outward than a centerline between inner and outer peripheral edges of the inlet opening in plan view.

5. The indoor unit of claim 1, wherein the air guide is inclined upward in a line from an outer periphery toward an inside of the air inlet.

6. An indoor unit for an air conditioner provided in a ceiling, the indoor unit comprising:
- an indoor unit body, mounted in the ceiling, including a fan and a heat exchanger arranged inside the indoor unit body, and controlling a temperature of air flowing out an outlet port; and
- a decorative panel provided under the indoor unit body, wherein
- the decorative panel includes
  - a panel body vertically penetrated by an air inlet at its central portion, and by air outlets around the air inlet,
  - a grille being a plate provided at a lower end portion of the air inlet, and covering a central portion of the air inlet to form an inlet opening between an outer peripheral edge of the grille and an opening edge of the air inlet in plan view, and
  - an air guide extending along an inner surface of the air inlet, and provided inside the air inlet such that an upper edge of the air guide is located more inward than a lower edge of the air guide,
- the upper edge of the air guide is located above the lower end of the air inlet,
- the lower edge of the air guide surrounds an outer periphery of the grille in plan view,
- the lower edge of the air guide is located between inner and outer peripheral edges of the inlet opening in plan view, and divides the inlet opening into a first ventilation path and a second ventilation path,
- the first ventilation path is located more inward than the lower edge of the air guide,
- the second ventilation path is located more outward than the lower edge of the air guide, and
- a first opening surrounded by the upper edge of the air guide has a larger opening area than a second opening interposed between the upper edge of the air guide and an inner peripheral surface of the air inlet in plan view.

7. The indoor unit of claim 6, wherein a ratio of the inlet opening area of the first ventilation path to the inlet opening area of the second ventilation path is higher than or equal to a ratio of the opening area of the first opening to the opening area of the second opening.

8. The indoor unit of claim 6, wherein the first ventilation path is located more inward than the lower edge of the air guide, the second ventilation path is located more outward than the lower edge of the air guide, and the first ventilation path has a larger inlet opening area than the second ventilation path.

9. The indoor unit of claim 6, wherein a curvature radius of the air guide having a curvature center at the outer peripheral edge of the grille gradually increases from the lower edge toward the upper edge of the air guide.

10. The indoor unit of claim 6, wherein the lower edge of the air guide is located more outward than a centerline between inner and outer peripheral edges of the inlet opening in plan view.

11. The indoor unit of claim 6, wherein the air guide is inclined upward in a line from an outer periphery toward an inside of the air inlet.

12. An indoor unit for an air conditioner provided in a ceiling, the indoor unit comprising:

an indoor unit body, mounted in the ceiling, including a fan and a heat exchanger arranged inside the indoor unit body, and controlling a temperature of air flowing out an outlet port; and a decorative panel provided under the indoor unit body, wherein the decorative panel includes a panel body vertically penetrated by an air inlet at its central portion, and by air outlets around the air inlet, a grille being a plate provided at a lower end portion of the air inlet, and covering a central portion of the air inlet to form an inlet opening between an outer peripheral edge of the grille and an opening edge of the air inlet in plan view, and an air guide extending along an inner surface of the air inlet, and provided inside the air inlet such that an upper edge of the air guide is located more inward than a lower edge of the air guide, the upper edge of the air guide is located above the lower end of the air inlet, the lower edge of the air guide surrounds an outer periphery of the grille in plan view, and the air guide includes a first connecting portion extending to an inside of the air inlet to be connected to an inner peripheral portion of the air inlet, and a second connecting portion extending to the grille to be connected to the grille.

13. The indoor unit of claim 12, wherein the lower edge of the air guide is located between inner and outer peripheral edges of the inlet opening in plan view, and divides the inlet opening into a first ventilation path and a second ventilation path, the first ventilation path is located more inward than the lower edge of the air guide, the second ventilation path is located more outward than the lower edge of the air guide, and the first ventilation path has a larger inlet opening area than the second ventilation path.

14. The indoor unit of claim 12, wherein a curvature radius of the air guide having a curvature center at the outer peripheral edge of the grille gradually increases from the lower edge toward the upper edge of the air guide.

15. The indoor unit of claim 12, wherein the lower edge of the air guide is located more outward than a centerline between inner and outer peripheral edges of the inlet opening in plan view.

16. The indoor unit of claim 12, wherein the air guide is inclined upward in a line from an outer periphery toward an inside of the air inlet.

* * * * *